US009829820B2

(12) United States Patent
Masumoto et al.

(10) Patent No.: US 9,829,820 B2
(45) Date of Patent: Nov. 28, 2017

(54) TONER AND METHOD FOR PRODUCING TONER

(71) Applicant: CANON KABUSHIKI KAISHA, Tokyo (JP)

(72) Inventors: Akane Masumoto, Yokohama (JP); Kunihiko Nakamura, Gotemba (JP); Tsuneyoshi Tominaga, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/745,345

(22) Filed: Jun. 19, 2015

(65) Prior Publication Data

US 2015/0286157 A1 Oct. 8, 2015

Related U.S. Application Data

(63) Continuation of application No. PCT/JP2015/000957, filed on Feb. 25, 2015.

(30) Foreign Application Priority Data

Mar. 27, 2014 (JP) ..... 2014-067127
Sep. 30, 2014 (JP) ..... 2014-199726

(51) Int. Cl.
*G03G 9/087* (2006.01)
*G03G 9/097* (2006.01)
*G03G 9/08* (2006.01)

(52) U.S. Cl.
CPC ..... *G03G 9/09733* (2013.01); *G03G 9/081* (2013.01); *G03G 9/0806* (2013.01); *G03G 9/0825* (2013.01); *G03G 9/08795* (2013.01); *G03G 9/08797* (2013.01); *G03G 9/09708* (2013.01)

(58) Field of Classification Search
CPC ..... G03G 9/09307; G03G 9/09321; G03G 9/0935
See application file for complete search history.

(56) References Cited

U.S. PATENT DOCUMENTS 5,066,559 A 11/1991 Elmasry et al.
5,328,795 A 7/1994 Yamashiro et al.
5,429,901 A 7/1995 Muto et al.
7,157,539 B2 1/2007 Sato et al.
7,866,806 B2 1/2011 Sato et al.
8,372,573 B2 2/2013 Ayaki et al.
8,551,680 B2 10/2013 Ayaki et al.
8,574,801 B2 11/2013 Itabashi et al.
8,609,312 B2 12/2013 Itabashi et al.
9,029,056 B2 5/2015 Kenmoku et al.
9,079,989 B2 7/2015 Yasumatsu et al.
9,098,002 B2 8/2015 Kenmoku et al.
9,098,003 B2 8/2015 Masumoto et al.
2009/0246669 A1 10/2009 Uno
2009/0291380 A1 11/2009 Ayaki et al.
2009/0291383 A1 11/2009 Ayaki et al.
2013/0045442 A1* 2/2013 Moriya ..... G03G 9/09328 430/105
2013/0065174 A1 3/2013 Itabashi et al.
2013/0164673 A1 6/2013 Yoshida et al.
2015/0277251 A1 10/2015 Tominaga et al.

FOREIGN PATENT DOCUMENTS

EP 2 677 366 12/2013
JP 2-256071 A 10/1990
JP 4-212971 A 8/1992
JP 6-130726 A 5/1994
JP 2004-176036 A 6/2004
JP 2005-281660 A 10/2005
JP 2007-86567 A 4/2007
JP 2011-075934 * 4/2011 ..... G03G 9/087
JP 2011-75934 A 4/2011
JP 2011-137967 A 7/2011
JP 2011-215311 A 10/2011
JP 2012-214797 * 11/2012 ..... G03G 9/097
JP 2012-256042 A 12/2012
(Continued)

OTHER PUBLICATIONS

Translation of JP 2011-075934 published Apr. 2011.*
Translation of JP 2012-214797 published Nov. 2012.*
International Search Report dated May 12, 2015 in International Application No. PCT/JP2015/000957.

*Primary Examiner* — Peter Vajda
(74) *Attorney, Agent, or Firm* — Fitzpatrick Cella Harper and Scinto

(57) ABSTRACT

The present invention is directed to providing a toner having no environmental difference in charging performance, and having high stability of images after output of a large number of copies under environments at high temperature and high humidity in a higher-speed one-component developing system, and a method for producing the toner, and the toner comprises a toner particle including a toner base particle containing a binder resin, a colorant and a releasing agent; and a resin particle adhering to the surface of the toner base particle, wherein the resin particle contains a resin A, and the resin A has an ionic functional group and an acid dissociation constant pKa of 7.0 or more and 9.0 or less, and the resin A has a monovalent group a represented by Formula (1):

Formula (1)

17 Claims, 3 Drawing Sheets

(56) References Cited

FOREIGN PATENT DOCUMENTS

| | | | |
|---|---|---|---|
| JP | 2012-256043 | A | 12/2012 |
| JP | 2012-256044 | A | 12/2012 |
| JP | 2013-120210 | A | 6/2013 |
| JP | 2013-152444 | A | 8/2013 |
| JP | 2014-67021 | A | 4/2014 |
| WO | 2012/157713 | A1 | 11/2012 |
| WO | 2012/157781 | | 11/2012 |

* cited by examiner

TONER AND METHOD FOR PRODUCING TONER

CROSS-REFERENCE TO RELATED APPLICATIONS

This application is a continuation of International Application No. PCT/JP2015/000957, filed Feb. 25, 2015, which claims the benefit of Japanese Patent Application No. 2014-067127, filed Mar. 27, 2014, and Japanese Patent Application No. 2014-199726, filed Sep. 30, 2014.

BACKGROUND OF THE INVENTION

Field of the Invention

The present invention relates to a toner for developing electrostatically charged images in an image forming method, such as electrophotography or electrostatic printing, and a method for producing a toner.

Description of the Related Art

Recently, copiers and printers have been used in new market regions, and have been also used under different environments. Such circumstances require higher speed printing and high stability of images. For example, printers, which have been used mainly in offices traditionally, are used under severe environments at high temperature and high humidity. Printers using a high-speed one-component developing scheme have been receiving attention to satisfy requirements for a reduction in size, an increase in speed, and higher stabilization. The toner for the one-component developing scheme contacts a charging member less frequently compared to the toner for the two-component developing scheme using a carrier. Accordingly, a relatively large stress should be applied to the toner for the one-component developing scheme to be charged at a predetermined amount of charging. To satisfy these requirements, the durability of the toner and the stability of the charging performance irrespective of different environments should be enhanced not only under normal environments but also under environments at high temperature and high humidity.

Addition of a charge controlling agent to a toner has been traditionally examined to attain stabilization of charge, higher quality of images, and maintenance of image quality even after output of a large number of prints. Especially, toners containing a charge controlling resin are effective. For example, Japanese Patent Application Laid-Open No. 2012-256044 suggests a toner containing a charge controlling resin having a benzyloxysalicylic acid structure. Such a toner has high charging properties, and can suppress a reduction in fluidity even after storage under high temperature and high humidity, attaining stable charging performance. Japanese Patent Application Laid-Open No. 2011-137967 suggests a toner including a toner particle containing a resin capable of generating electricity, and resin particles adhering to the surface of the toner particle and being capable of dissipating charges. Such a toner keeps the charge density on the surface thereof appropriately low. This low charge density suppresses electrostatic aggregation of toner particles if an external additive is buried into toner particles after output of a large number of prints, barely causes deficits in images, and enhances durability under normal environments.

Unfortunately, this toner has insufficient stability of charging performance and durability under severe environments. Particularly, if the toner is used in printing at a higher process speed, the durability after output of a large number of prints is insufficient and stability of images is unsatisfactory under environments at high temperature and high humidity.

SUMMARY OF THE INVENTION

The present invention is directed to providing a toner for a higher-speed one-component developing system having stable charging properties, sufficient durability, and high stability of images not only under normal environments but also under severe environments, and a method for producing the toner.

According to one aspect of the present invention, there is provided a toner comprising a toner particle including a toner base particle containing a binder resin, a colorant and a releasing agent; and a resin particle adhering to the surface of the toner base particle, wherein the resin particle contains a resin having an ionic functional group and an acid dissociation constant pKa of 7.0 or more and 9.0 or less.

According to another aspect of the present invention, there is provided a method for producing a toner, the toner comprising a toner particle including a toner base particle containing a binder resin, a colorant and a releasing agent, and a resin particle adhering to the surface of the toner base particle, the method including, in this order:

(i) forming particles of a polymerizable monomer composition containing a polymerizable monomer and a colorant in an aqueous medium, (ii) polymerizing the polymerizable monomer contained in the particles of the polymerizable monomer composition to prepare a dispersion liquid B containing the toner base particle, (iii) adding the resin particle to the dispersion liquid B to prepare a dispersion liquid C, and (iv) heating the dispersion liquid C to a temperature equal to or higher than a glass transition temperature (Tg) of the toner base particle to cause the resin particle to adhere to the surface of the toner base particle to prepare a toner particle, wherein the resin particle contains a resin having an ionic functional group and an acid dissociation constant pKa of 7.0 or more and 9.0 or less.

According to the present invention, a toner having stable charging properties and high durability not only under normal environments but also under severe environments, and having high stability of images even in image formation at a high-speed one-component developing system can be obtained.

Further features of the present invention will become apparent from the following description of exemplary embodiments with reference to the attached drawings.

DESCRIPTION OF THE EMBODIMENTS

Figure 1:
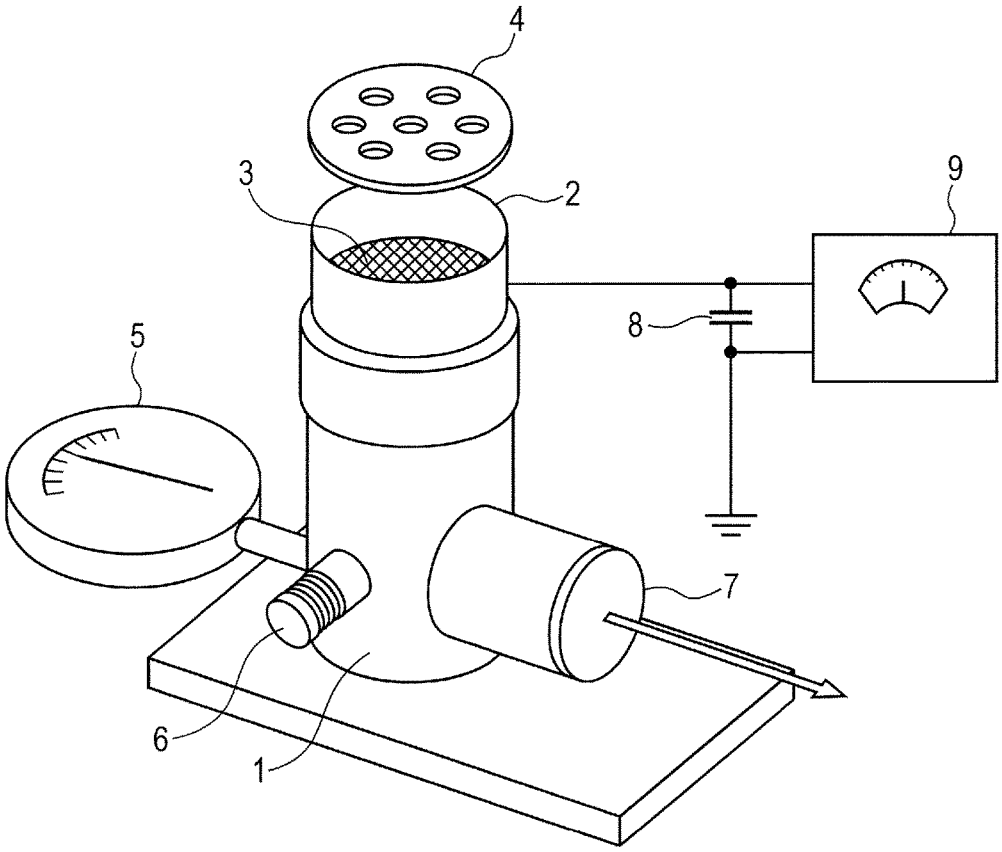
FIG. 1 illustrates an apparatus for measuring the amount of charging in the present invention.

Preferred embodiments of the present invention will now be described in detail in accordance with the accompanying drawings.

The present invention relates to a toner including a toner particle including a toner base particle containing a binder resin, a colorant and a releasing agent; and a resin particle adhering to the surface of the toner base particle, wherein the resin particle contains a resin having an ionic functional group and an acid dissociation constant pKa of 7.0 or more and 9.0 or less (hereinafter referred to as resin A).

Such a toner has stable charging properties and high durability not only under normal environments but also under severe environments, and has high stability of images even in image formation in a high-speed one-component developing system.

The resin having an ionic functional group and an acid dissociation constant pKa of 7.0 or more and 9.0 or less exhibits high charging performance under environments at high humidity. This resin will now be described.

Typically, the resin having an ionic functional group that is often used is a resin having a functional group such as a sulfonate group or a carboxyl group. Unfortunately, such a resin readily adsorbs moisture content, and may reduce the amount of charging under high temperature and high humidity. However, if the resin has an acid dissociation constant pKa of 7.0 or more and 9.0 or less, the resin has low moisture absorbing properties, and therefore can suppress a reduction in the amount of charging under a highly humid environment.

A resin having an acid dissociation constant pKa of less than 7.0, significantly absorbs moisture content to reduce the charging properties under high humidity. A resin having an acid dissociation constant pKa of more than 9.0 leads to a low charging ability, so that the toner cannot be sufficiently charged.

The acid dissociation constant pKa can be determined from the result of neutralization titration described later.

The resin having an ionic functional group can be any resin satisfying the acid dissociation constant pKa. Examples thereof include resins having hydroxyl groups bonded to aromatic rings, and resins having carboxyl groups bonded to aromatic rings.

The resin A can be a resin having a monovalent group a represented by Formula (1) as the molecular structure.

Formula (1)

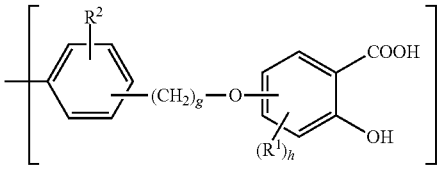

wherein $R^1$ represents a hydroxy group, a carboxy group, an alkyl group having 1 or more and 18 or less carbon atoms, or an alkoxy group having 1 or more and 18 or less carbon atoms; $R^2$ represents a hydrogen atom, a hydroxy group, an alkyl group having 1 or more and 18 or less carbon atoms, or an alkoxy group having 1 or more and 18 or less carbon atoms; g represents an integer of 1 or more and 3 or less; h represents an integer of 0 or more and 3 or less; and when h is 2 or 3, a number h of $R^1$ may be the same or different.

Examples of the alkyl group for $R^1$ and $R^2$ include a methyl group, an ethyl group, a propyl group, an isopropyl group, a butyl group, an isobutyl group, a s-butyl group and a t-butyl group. Examples of the alkoxy group for $R^1$ and $R^2$ include a methoxy group, an ethoxy group and a propoxy group.

The monovalent group a represented by Formula (1) can have a structure where $R^1$ represents an alkyl group having 1 or more and 18 or less carbon atoms or an alkoxy group having 1 or more and 18 or less carbon atoms; $R^2$ represents a hydrogen atom; g represents an integer of 1 or more and 3 or less; h represents an integer of 0 or more and 3 or less; and when h is 2 or 3, a number h of $R^1$ may be the same or different.

The resin A can have any main chain structure without limitation. Examples of the resin A include vinyl polymers, polyester polymers, polyamide polymers, polyurethane polymers and polyether polymers. Examples thereof also include hybrid polymers of combinations of two or more of these polymers. Among these polymers, polyester polymers or vinyl polymers are preferred in view of the tight adhesion to the toner base particle. A vinyl polymer having a monovalent group a represented by Formula (1) as a partial structure of a unit represented by Formula (2) is more preferred.

Formula (2)

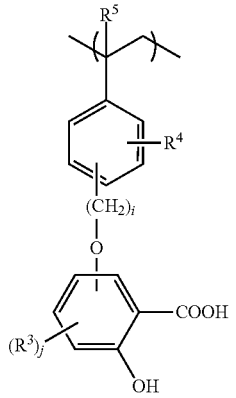

where $R^3$ represents a hydroxy group, a carboxy group, an alkyl group having 1 or more and 18 or less carbon atoms, or an alkoxy group having 1 or more and 18 or less carbon atoms;

$R^4$ represents a hydrogen atom, a hydroxy group, an alkyl group having 1 or more and 18 or less carbon atoms, or an alkoxy group having 1 or more and 18 or less carbon atoms;

$R^5$ represents a hydrogen atom or a methyl group;

i represents an integer of 1 or more and 3 or less; j represents an integer of 0 or more and 3 or less; and when j is 2 or 3, $R^3$ can be each independently selected.

Examples of the alkyl group for $R^3$ and $R^4$ include a methyl group, an ethyl group, a propyl group, an isopropyl group, a butyl group, an isobutyl group, a s-butyl group and a t-butyl group. Examples of the alkoxy group include a methoxy group, an ethoxy group and a propoxy group.

The resin A can have a weight average molecular weight of 1000 or more and 100000 or less determined by gel permeation chromatography (GPC). A weight average molecular weight within this range balances the strength and the charging properties of the resin particle. To control the weight average molecular weight within this range, conditions during production of the resin A, such as the amount of a reagent, the reaction temperature, and the concentration of the solvent are varied. The resin A having a desired molecular weight can be obtained by separation by GPC.

The content of the monovalent group a represented by Formula (1) per gram of the resin A can be 50 μmol or more and 1000 μmol or less. A content of 50 μmol or more can attain high charging properties and durability. A content of 1000 μmol or less can suppress charge up.

Typically, charge controlling resins having an acidic polar group such as sulfonic acid or carboxylic acid are often used. Such resins readily adsorb moisture content, and the absorbed moisture content may inhibit charging performance under high temperature and high humidity.

The toner according to the present invention barely causes such deficits attributed to moisture content, and can reduce an environmental difference in charging performance. Although the detail has not been clarified yet, the present inventor infers the following reason. The resin particles containing the resin A having the monovalent group a represented by Formula (1) exhibit charging performance. The resin A has a polar group including the monovalent group a represented by Formula (1). The monovalent group a represented by Formula (1) has a larger acid dissociation constant pKa than that of the structure of a polar moiety of a typical charge controlling resin. In turn, the resin A has a large pKa to reduce influences of the absorbed moisture content.

The resin A can have a pKa of 7.0 or more and 8.0 or less. The resin A having a pKa of 7.0 or more reduces the environmental difference in charging properties caused by the absorbed moisture content more significantly. The resin A having a pKa of 8.0 or less can have an appropriate amount of charging. pKa can be determined from the result of neutralization titration, which will be described later.

The resin A can be produced by any method without limitation, and can be produced by any known technique. A vinyl polymer can be produced, for example, by a method for copolymerizing Polymerizable monomer M (Formula (3)) having a monovalent group a represented by Formula (1) with a vinyl monomer using a polymerization initiator.

Formula (3)

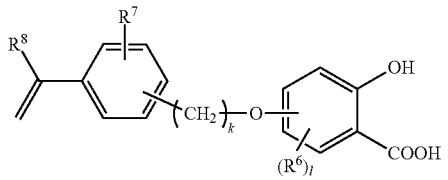

where $R^6$ represents a hydroxy group, a carboxy group, an alkyl group having 1 or more and 18 or less carbon atoms, or an alkoxy group having 1 or more and 18 or less carbon atoms;

$R^7$ represents a hydrogen atom, a hydroxy group, an alkyl group having 1 or more and 18 or less carbon atoms, or an alkoxy group having 1 or more and 18 or less carbon atoms;

$R^8$ represents a hydrogen atom or a methyl group;

k represents an integer of 1 or more and 3 or less; 1 represents an integer of 0 or more and 3 or less; and when 1 is 2 or 3, $R^6$ can be each independently selected.

Specific examples of polymerizable monomers having a monovalent group a are shown in Table 1.

TABLE 1

| Polymerizable monomer | Structural formula | R6 H, OH, COOH, alkyl or alkoxy group having 1 to 18 carbon atoms | R7 H, OH, COOH, alkyl or alkoxy group having 1 to 18 carbon atoms | R8 H or methyl group | k 1 to 3 | l 1 to 3 |
|---|---|---|---|---|---|---|
| M-1 | 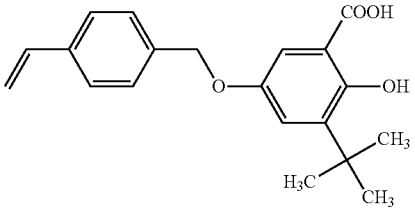 | tert-Butyl | H | H | 1 | 1 |
| M-2 | 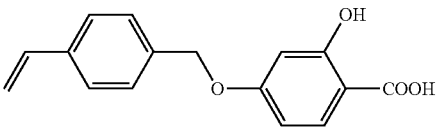 | H | H | H | 1 | 1 |
| M-3 | 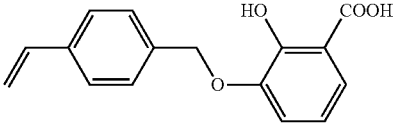 | H | H | H | 1 | 1 |
| M-4 | 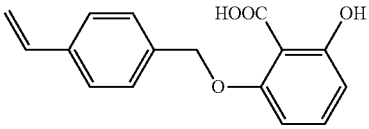 | H | H | H | 1 | 1 |

TABLE 1-continued
| Polymerizable monomer | Structural formula | R6 H, OH, COOH, alkyl or alkoxy group having 1 to 18 carbon atoms | R7 H, OH, COOH, alkyl or alkoxy group having 1 to 18 carbon atoms | R8 H or methyl group | k 1 to 3 | l 1 to 3 |
|---|---|---|---|---|---|---|
| M-5 | 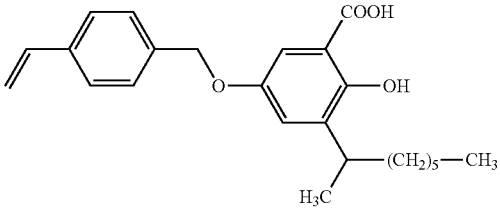 | iso-Octyl | H | H | 1 | 1 |
| M-6 | 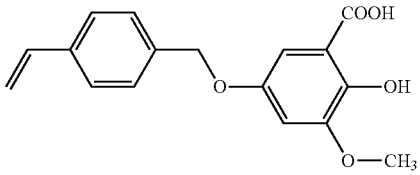 | MeO | H | H | 1 | 1 |
| M-7 | 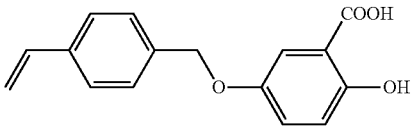 | H | H | H | 1 | 1 |
| M-8 | 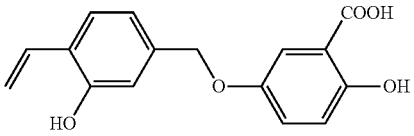 | H | OH | H | 1 | 1 |
| M-9 | 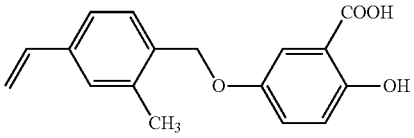 | H | Me | H | 1 | 1 |
| M-10 | 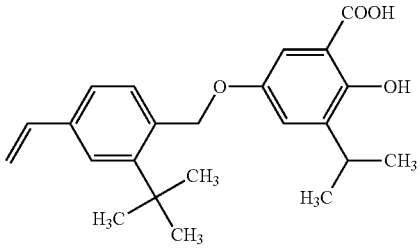 | iso-Propyl | tert-Butyl | H | 1 | 1 |
| M-11 | 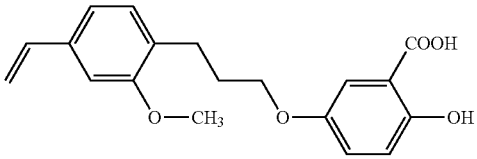 | H | MeO | H | 3 | 1 |
| M-12 | 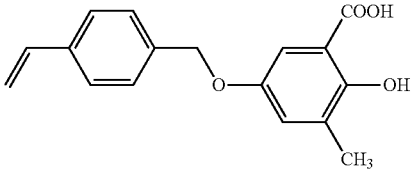 | Me | H | H | 1 | 1 |

Any vinyl monomer can be copolymerized with Polymerizable monomer M without limitation. Specifically, examples thereof include styrenes such as styrene, o-methylstyrene, m-methylstyrene, p-methylstyrene and α-methylstyrene and derivatives thereof; ethylene unsaturated monoolefins such as ethylene, propylene, butylene and isobutylene; halogenated vinyls such as vinyl chloride, vinylidene chloride, vinyl bromide and vinyl fluoride; vinyl esters such as vinyl acetate, vinyl propionate and vinyl benzoate; acrylic acid esters such as n-butyl acrylate and 2-ethylhexyl acrylate; methacrylic acid esters such as n-butyl methacrylate and 2-ethylhexyl methacrylate; methacrylic acid amino esters such as dimethylaminoethyl methacrylate and diethylaminoethyl methacrylate; vinyl ethers such as vinyl methyl ether and vinyl ethyl ether; vinyl ketones such as vinyl methyl ketone; N-vinyl compounds such as N-vinylpyrrole; vinylnaphthalenes; derivatives of acrylic acid or methacrylic acid such as acrylonitrile, methacrylonitrile and acrylamide; acrylic acid; and methacrylic acid. These vinyl monomers can be used in combinations of two or more when necessary.

Polymerization initiators usable in copolymerization of the polymerizable monomer components are various types of polymerization initiators such as peroxide polymerization initiators and azo polymerization initiators. Examples of usable organic peroxide polymerization initiators include peroxy esters, peroxydicarbonates, dialkyl peroxides, peroxyketals, ketone peroxides, hydroperoxides and diacyl per oxides. Examples of usable inorganic peroxide polymerization initiators include persulfates and hydrogen peroxide. Specifically, examples thereof include peroxy esters such as t-butyl peroxyacetate, t-butyl peroxypivalate, t-butyl peroxyisobutyrate, t-hexyl peroxyacetate, t-hexyl peroxypivalate, t-hexyl peroxyisobutyrate, t-butyl peroxyisopropylmonocarbonate and t-butyl peroxy-2-ethylhexylmonocarbonate; diacyl peroxides such as benzoyl peroxide; peroxydicarbonates such as diisopropyl peroxydicarbonate; peroxyketals such as 1,1-di-t-hexylperoxycyclohexane; dialkyl peroxides such as di-t-butyl peroxide; and t-butyl peroxyallylmonocarbonate. Examples of usable azo polymerization initiators include 2,2'-azobis-(2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile, azobisisobutyronitrile and dimethyl-2,2'-azobis(2-methylpropionate).

Two or more of these polymerization initiators can be used at the same time when necessary. The polymerization initiator can be used in amount of 0.100 parts by mass or more and 20.0 parts by mass or less relative to 100 parts by mass of the polymerizable monomer. These monomer components can be polymerized by any method such as solution polymerization, suspension polymerization, emulsion polymerization, dispersion polymerization and precipitation polymerization, or bulk polymerization without limitation.

If the resin A having the monovalent group a represented by Formula (1) is a polyester resin, known different production methods can be used. Examples thereof include I) a method for converting reaction residues of carboxy groups or hydroxy groups contained in a polyester structure into a monovalent group a represented by Formula (1) by an organic reaction;

II) a method for preparing polyester with a polyhydric alcohol or polyvalent carboxylic acid having a monovalent group a represented by Formula (1) as a substituent; and III) a method for preliminarily introducing a functional group into a polyhydric alcohol or a polyvalent carboxylic acid, the functional group allowing introduction of a monovalent group a represented by Formula (1) as a substituent.

If the resin A having the monovalent group a represented by Formula (1) is a hybrid resin, examples of production methods include IV) a method for hybridizing a polyester resin containing a monovalent group a represented by Formula (1) as a substituent with a vinyl monomer;

V) a method for polymerizing a vinyl monomer having a carboxy group such as acrylic acid and methacrylic acid, and converting the carboxy group into a structure represented by Formula (1) by an organic reaction; and VI) a method for hybridizing a polyester resin with Polymerizable monomer M having a structure a represented by Formula (3).

A polyester resin can be hybridized with a vinyl monomer by any known method, and method IV) is effective. Specifically, examples thereof include a method for modifying a polyester resin by polymerizing a vinyl monomer in the presence of a peroxide initiator, and a method for graft modifying a polyester resin having an unsaturated group to prepare a hybrid resin.

Specific examples of method V) by introduction of a monovalent group a represented by Formula (1) include a method for amidizing a carboxy group in a resin with a compound having an amino group introduced into a monovalent group a represented by Formula (1).

In one specific example of method VI), Polymerizable monomer M represented by Formula (3) can be used.

In the present invention, the weight average molecular weight of the resin A can be adjusted by any known method. Specifically, the weight average molecular weight of a polyester resin can be arbitrarily adjusted by adjusting the ratio of an acid component to an alcohol component to be used or the polymerization time. In the hybrid resin, the weight average molecular weight of the polymer can be adjusted by adjustment of the molecular weight of the vinyl-modified unit in addition to adjustment of the molecular weight of the polyester component. Specifically, the weight average molecular weight of the polymer can be arbitrarily adjusted by adjusting the amount of a radical initiator, the polymerization temperature or the like in a reaction step of modifying a polyester resin by polymerizing a vinyl monomer. In the present invention, the polyester resin can be hybridized with any of the vinyl monomers listed above.

The content of the monovalent group a represented by Formula (1) relative to the total mass of the resin A can be determined by the following method.

First, the acid value of the resin A is determined by titration of the resin A according to the method described below, and the amount of carboxy group derived from the monovalent group a represented by formula (1) in the resin A is calculated. From the calculated content, the content (μmol) of the monovalent group a represented by formula (1) per 1 g of the resin A can be calculated. If the resin A has a carboxy group in a site other than the monovalent group a represented by formula (1), the acid value of a compound (for example, polyester resin) immediately before addition reaction of the monovalent group a represented by formula (1) is preliminarily determined in the preparation of the resin A. The amount of the monovalent group a represented by formula (1) to be added can be calculated from the difference between the preliminarily determined acid value and the acid value of the resin A after the addition reaction.

Alternatively, the resin A is measured by NMR. From the integrated values derived from the characteristic chemical shift values of the monomer components, the molar ratio of the components can be calculated. From the molar ratio, the content (μmol) can be calculated.

The toner according to the present invention includes a toner particle to which a resin particle containing the resin A adheres. In the present invention, the resin particle can be produced by any method. The resin particle may be a powder, or may be a dispersion in a certain medium. A resin particle dispersed in an aqueous medium is suitably used. For example, resin particles produced by a known method such as emulsion polymerization, soap-free emulsion polymerization or phase inversion emulsification can be used. Among these production methods, phase inversion emulsification can be particularly used because resin particles having smaller particle diameters are readily produced without any emulsifier or dispersion stabilizer.

Phase inversion emulsification uses a self-dispersible resin or a resin which can have self-dispersibility by neutralization. In this method, the self-dispersibility in an aqueous medium is exhibited in a resin having a hydrophilic group in the molecule. Specifically, a resin having a polyether group or an ionic group has high self-dispersibility. The resin A has a carboxy group in the monovalent group a, and the carboxy group attains the self-dispersibility of the resin A. Neutralization of the carboxy group increases its hydrophilicity, which enables self-dispersion of the resin A in an aqueous medium.

The resin A is dissolved in an organic solvent. A neutralizer is added, and the solution is mixed with an aqueous medium with stirring. The dissolution solution of the resin A is then subjected to phase inversion emulsification to generate microparticles. The organic solvent is removed after phase inversion emulsification by a method such as heating or reducing pressure. Phase inversion emulsification thus can prepare a stable aqueous dispersion of resin particles substantially without any emulsifier or dispersion stabilizer.

Furthermore, the present inventor has found that when the resin particle is produced as an aqueous dispersion and adheres to the surface of the toner base particle, a toner containing such a resin particle can attain significantly high stability of images after output of a large number of prints. If a large number of prints are output in a one-component developing system, an external additive is buried into the toner particle due to a stress applied between a developer carrier and a developer regulating blade or between the developer carrier and a photosensitive drum. These phenomena degrade image quality after output of a large number of prints. In particular, such degradation is remarkable at printing at a higher process speed under environments at high temperature and high humidity.

The toner according to the present invention can suppress burying of the external additive even under environments at high temperature and high humidity, and therefore stability of images (that is, durability) can be maintained even after output of a large number of prints. This advantageous effect is particularly remarkable when a resin A having a monovalent group a represented by Formula (1) is used. Although the mechanism is unclear, the present inventor infers the following mechanism. The monovalent group a represented by Formula (1), which includes a salicylic acid site bonded via a benzyloxy group, has a highly flexible structure projected from the main chain of the resin A. In preparation of an aqueous dispersion of the resin particle containing the resin A, it is thought that the highly polar carboxy group of salicylic acid is oriented on the outermost surface of the resin A. For this reason, the resin particle containing the resin A having a monovalent group a contains the salicylic acid sites disposed closely to each other on the outermost surface thereof. In such a resin particle, a network of hydrogen bond is formed to increase the surface strength of the resin particle. The resin A is contained in a higher concentration compared to the resin A preliminarily added to the toner base particle as a component thereof, so that hydrogen bonds are formed at a high density to attain higher advantageous effects.

The amount of the adhering resin particle can be 0.1 parts by mass or more and less than 5.0 parts by mass relative to 100 parts by mass of toner base particle. An amount of 0.1 parts by mass or more attains high charging properties due to toner particles having uniform adhesion and sufficient durability. An amount of less than 5.0 parts by mass can ensure high durability and reduce image deficits derived from excess resin particles.

The resin particles applied to the surface of the toner base particle may be buried into the toner base particle by a mechanical impact force for firm adhesion to the toner base particle. Alternatively, the resin particles may be smoothed by heating to a temperature equal to or higher than the glass transition temperature (Tg) for adhesion to the toner base particle.

Moreover, in the present invention, the toner particle can contain at least one metal element selected from the group consisting of magnesium, calcium, barium and aluminum, which attains higher durability. Although the reason is unclear, the present inventor considers that the carboxy group on the surface of the toner base particle and the carboxy group of the resin particle are bonded to the same metal element so that the resin particle firmly adheres to the surface of the toner base particle.

Accordingly, the toner base particle can contain a resin having a carboxy group. The resin having a carboxy group suitably used is the same resin usable as a binder resin described later. These resins having carboxy groups introduced thereto such that the acid values of the resins are 5.0 mgKOH/g or more and 30.0 mgKOH/g or less can be used. An acid value within this range effectively orients the carboxy groups on the surface of the toner base particle and accelerates introduction of the metal element.

The metal element is preferably contained in a content of 10 ppm or more and 1000 ppm or less relative to the total mass of the toner particle. The content is more preferably 20 ppm or more and 200 ppm or less relative to the total mass of the toner particle. The content is particularly preferably 50 ppm or more and 200 ppm or less relative to the total mass of the toner particle. A content of the metal element within this range attains particularly high charging properties and durability under high temperature and high humidity. A method for determining the content of the metal element will be described later.

The metal element can be contained in the toner by any method. A method for adhering resin particles to the surfaces of the toner base particles in an aqueous medium can be used. If the adhesion is performed at a pH higher than the pKa of the resin particle, the carboxy group on the surface of the resin particle can be readily dissociated to promote bonding of the carboxy group to the metal element and thus increase the metal element contained in the toner. Alternatively, the content of the metal element in the toner particle can be controlled by the pH during washing subsequent to the adhesion.

The toner according to the present invention can contain any binder resin without limitation. Examples of the binder resin include: styrene resins, acrylic resins, methacrylic resins, styrene-acrylic resins, styrene-methacrylic resins, polyethylene resins, polyethylene-vinyl acetate resins, vinyl acetate resins, polybutadiene resins, phenol resins, polyurethane resins, polybutyral resins, polyester resins and hybrid resins in which any of the above resins are combined. Among these binder resins, the following can be desirably used in view of the properties of the toner: styrene resins, acrylic resins, methacrylic resins, styrene-acrylic resins, styrene-methacrylic resins, polyester resins, or hybrid resins obtained by combining styrene-acrylic resins or styrene-methacrylic resins and polyester resins.

The polyester resin usable is a polyester resin typically produced with polyhydric alcohol and carboxylic acid, carboxylic anhydride or carboxylic acid ester as raw material monomers. Specifically, the same polyhydric alcohol component and the same polyvalent carboxylic acid component as those in the polyester resin can be used. Among these components, particularly preferred is a polyester resin prepared by condensation polymerization of the following components. Examples of a diol component include bisphenol derivatives. Examples of an acid component include carboxylic acid components such as di- or higher valent carboxylic acids or acid anhydrides thereof; and lower alkyl esters of fumaric acid, maleic acid, maleic anhydride, phthalic acid, terephthalic acid, trimellitic acid and pyromellitic acid.

The toner according to the present invention can also be used as a magnetic toner. In this case, the following magnetic substances are used. Examples of the magnetic substance include iron oxides such as magnetite, maghemite and ferrite, or iron oxides containing other metal oxides; metals such as Fe, Co and Ni, alloys of these metals and metals such as Al, Co, Cu, Pb, Mg, Ni, Sn, Zn, Sb, Ca, Mn, Se and Ti, and mixtures thereof; triiron tetraoxide ($Fe_3O_4$), diiron trioxide ($\gamma$-$Fe_2O_3$), zinc iron oxide ($ZnFe_2O_4$), copper iron oxide ($CuFe_2O_4$), neodymium iron oxide ($NdFe_2O_3$), barium iron oxide ($BaFe_{12}O_{19}$), magnesium iron oxide ($MgFe_2O_4$) and manganese iron oxide ($MnFe_2O_4$). These magnetic materials are used singly or in combinations of two or more. Particularly suitable magnetic materials are fine powders of triiron tetraoxide or $\gamma$-diiron trioxide.

These magnetic substances each have an average particle diameter of preferably 0.1 μm or more and 2 μm or less, more preferably 0.1 μm or more and 0.3 μm or less. For the magnetic properties under application of 795.8 kA/m (10 kOe), the coercivity (Hc) is 1.6 kA/m or more and 12 kA/m or less (20 Oe or more and 150 Oe or less), and the saturation magnetization ($\sigma s$) is 5 $Am^2/kg$ or more and 200 $Am^2/kg$ or less. The saturation magnetization is preferably 50 $Am^2/kg$ or more and 100 $Am^2/kg$ or less. The residual magnetization ($\sigma r$) can be 2 $Am^2/kg$ or more and 20 $Am^2/kg$ or less.

The magnetic substance can be in an amount of preferably 10.0 parts by mass or more and 200 parts by mass or less, more preferably 20.0 parts by mass or more and 150 parts by mass or less relative to 100 parts by mass of binder resin.

If the toner according to the present invention is used as a non-magnetic toner, known colorants such as various traditionally known dyes and pigments can be used.

Examples of coloring pigments for magenta include C.I. Pigment Reds 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:1, 48:2, 48:3, 48:4, 48:5, 49, 50, 51, 52, 53, 54, 55, 57:1, 58, 60, 63, 64, 68, 81:1, 81:2, 81:3, 81:4, 81:5, 83, 87, 88, 89, 90, 112, 114, 122, 123, 146, 147, 150, 163, 184, 185, 202, 206, 207, 209, 238, 269 and 282; C.I. Pigment Violet 19; and C.I. Vat Reds 1, 2, 10, 13, 15, 23, 29 and 35. These pigments can be used alone or in combination with dyes.

Examples of coloring pigments for cyan include copper phthalocyanine compounds and derivatives thereof; anthraquinone compounds; and basic dye lake compounds. Specific examples thereof include C.I. Pigment Blues 1, 7, 15, 15:1, 15:2, 15:3, 15:4, 60, 62 and 66.

Examples of coloring pigments for yellow include compounds such as condensation azo compounds, isoindolinone compounds, anthraquinone compounds, azo metal complexes, methine compounds and allylamide compounds. Specific examples thereof include C.I. Pigment Yellows 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C.I. Vat Yellows 1, 3 and 20.

Examples of usable black colorants include carbon black, aniline black, acetylene black, titanium black, and colorants toned to a black color by using the yellow, magenta, and cyan colorants listed above.

The toner according to the present invention may contain a releasing agent. Examples of the releasing agent include aliphatic hydrocarbon waxes such as low molecular weight polyethylene, low molecular weight polypropylene, microcrystalline wax and paraffin wax; oxides of aliphatic hydrocarbon waxes such as oxidized polyethylene wax; block copolymers of aliphatic hydrocarbon waxes; waxes mainly containing fatty acid esters such as carnauba wax, Sasolwax and montanic acid ester wax; and partially or completely deoxidized fatty acid esters such as deoxidized carnauba wax; partially esterified products of fatty acids such as monoglyceride behenate and polyhydric alcohol; and methyl ester compounds having a hydroxy group prepared by hydrogenation of vegetable oils and fats.

In the molecular weight distribution of the releasing agent, the main peak is within the region of a molecular weight of preferably 400 or more and 2400 or less, more preferably 430 or more and 2000 or less. Such a releasing agent can give preferred thermal properties to the toner. The releasing agent is added in a total amount of preferably 2.50 parts by mass or more and 40.0 parts by mass or less, more preferably 3.00 parts by mass or more and 15.0 parts by mass or less relative to 100 parts by mass of binder resin.

The toner particle according to the present invention can be produced by any method for adhering a resin particle to the surface of a toner base particle containing a binder resin, a colorant and a releasing agent. The toner particle can be produced by suspension polymerization.

In the present invention, the toner particle can be produced through suspension polymerization, specifically through the following steps (i) to (iv) in this order.

(i) a step of forming particles of a polymerizable monomer composition in an aqueous medium, the composition containing a polymerizable monomer and a colorant, (ii) a step of polymerizing the polymerizable monomer contained in the particles of the polymerizable monomer composition to prepare a dispersion liquid B containing the toner base particles, (iii) a step of adding the resin particles to the dispersion liquid B to prepare a dispersion liquid C, and (iv) a step of heating the dispersion liquid C to a temperature equal to or higher than the glass transition temperature (Tg) of the toner base particle for adhesion of the resin particles to the surfaces of the toner base particles to prepare toner particles.

In this method, the resin particle contains a resin having an ionic functional group and an acid dissociation constant pKa of 7.0 or more and 9.0 or less.

The production method will now be described from steps (i) to (iv).

In step (i), a polymerizable monomer composition containing a polymerizable monomer and a colorant is added to an aqueous medium to form particles of the polymerizable monomer composition in the aqueous medium. More specifically, a colorant is first added to a polymerizable monomer as a main material for a toner particle, and is uniformly dissolved or dispersed with a dispersing machine such as a homogenizer, a ball mill, a colloid mill or an ultrasonic dispersing machine to prepare a polymerizable monomer composition. At this time, additives such as a polyfunctional monomer, chain transfer agent, wax as a releasing agent, a charge control agent, a plasticizer and a dispersant can be properly added to the polymerizable monomer composition when necessary.

Next, the polymerizable monomer composition is added to a preliminarily prepared aqueous medium, and is suspended with a high-speed dispersing machine such as a high-speed stirrer or an ultrasonic dispersing machine to perform granulation.

At this time, the aqueous medium can contain a dispersion stabilizer to uniformly apply the resin particles and attain tight adhesion of the resin particles to the toner base particles.

The dispersion stabilizer can be particularly at least one compound selected from the group consisting of calcium phosphate compounds, aluminum phosphate compounds, magnesium phosphate compounds, calcium hydroxide compounds, aluminum hydroxide compounds, magnesium hydroxide compounds, calcium carbonate compounds, aluminum carbonate compounds and magnesium carbonate compounds. These dispersion stabilizers can control the particle diameter of the toner base particle. The metal element derived from the dispersion stabilizer is present on the surface of the toner base particle. It is thought that the toner base particle is bonded to the resin particles via the metal element to increase adhesion strength between the toner base particle and the resin particles.

A polymerization initiator may be mixed with other additives during preparation of the polymerizable monomer composition, or may be mixed with the polymerizable monomer composition immediately before the polymerizable monomer composition is suspended in the aqueous medium. Alternatively, the polymerization initiator can be added in the form of a dissolution in a polymerizable monomer or another solvent when necessary during or after granulation, that is, immediately before the polymerization reaction is started.

The particles of the polymerizable monomer composition are formed in the aqueous medium in this manner.

In the next step (ii), the suspension prepared through step (i) is heated to a temperature of 50° C. or higher and 90° C. or lower to perform a polymerization reaction with stirring while the particles of the polymerizable monomer composition in the suspension are kept as they are and floating or sedimentation of the particles are prevented.

The polymerization initiator readily decomposes by heating to generate radicals. The generated radicals are added to unsaturated bonds of the polymerizable monomer to further generate adducts of the radicals. The generated adducts of the radicals are further added to unsaturated bonds of the polymerizable monomer. Such a chain addition reaction is repeated to progress the polymerization reaction to form a toner base particle including the polymerizable monomer as the main material and prepare a dispersion liquid B containing the toner base particles. After this, a distillation step may be performed when necessary to remove the residual polymerizable monomer.

In step (iii), resin particles are added to the dispersion liquid B to apply the resin particles to the surfaces of the toner base particles to prepare a dispersion liquid C.

As a method for applying resin fine particles to the surface of the toner base particles, a method using the difference in potential between the resin fine particles and the toner base particles can be used. The resin fine particle has a negative potential. For this reason, such resin fine particles can be applied to the surfaces of the toner base particles having a positive potential. A positive potential is suitably applied to the surfaces of the toner base particles, for example, by a method for adding a cationic surfactant to the toner base particles or a method for adsorbing a dispersion stabilizer of a metal salt onto the surfaces of the toner base particles.

Among these methods, a method for adsorbing a dispersion stabilizer onto the surfaces of the toner base particles can be particularly used. While the dispersion liquid B is being stirred, an aqueous dispersion is added to the dispersion liquid B, the aqueous dispersion being prepared by dispersing resin particles having the same polarity as that of the toner base particles with respect to the dispersion stabilizer in an aqueous medium. This procedure can densely and uniformly apply the resin particles to the toner base particles whose surfaces adsorb the dispersion stabilizer.

To prevent aggregates including only the resin particles and more uniformly apply the resin particles, the aqueous dispersion of the resin particles can be added slowly. A suitable addition rate is 0.1 parts by mass/min or more and 5.0 parts by mass/min or less in terms of the solid content of the resin particle relative to 100 parts by mass of the solid content in the dispersion liquid B containing the toner base particles.

The temperature during addition of the resin particles to the dispersion liquid B may be any temperature at which aggregates including only the resin particles are not generated. The resin particles may be added to the dispersion liquid B in the state where the dispersion liquid B is preliminarily kept at a temperature equal to or higher than the Tg of the toner base particle.

In the present invention, the average particle diameter of the resin particle, which is defined as a median particle size determined by measurement of particle size distribution according to a laser light scattering method, is preferably within the range of 5 nm or more and 200 nm or less. The median particle size is more preferably within the range of 20 nm or more and 130 nm or less.

An average particle diameter of less than 5 nm may not attain sufficient durability. An average particle diameter of more than 200 nm may result in uneven adhesion.

The ratio (D50/D10) of the volume-based median particle size (D50) of the resin particle to the particle diameter (D10) can be 1.0 or more and 3.0 or less where the particle diameter (D10) is defined as a diameter when the number of cumulative particles corresponds to 10% of the volume distribution. The ratio (D90/D50) of the particle diameter (D90) to the volume-based median particle size (D50) of the resin particle can be 1.0 or more and 3.0 or less where the particle diameter (D90) is defined as a diameter when the number of cumulative particles corresponds to 90% of the volume distribution. A median particle size within these ranges indicates that the resin particles have uniform particle size distribution. Such uniform particle size distribution can attain a toner in which a fluctuation in adhesion of the resin particles is barely found between the toner particles, thereby attaining stable performance.

The resin particle more preferably contains the resin A having a monovalent group a represented by Formula (1) described above.

In the subsequent step (iv), the dispersion liquid C is heated to a temperature equal to or higher than the glass transition temperature (Tg) of the toner base particle to prepare toner particles.

The resin particles are applied to the dispersion stabilizer adsorbed onto the toner base particles. The resin particles then undergo stirring energy to move to the surfaces of the toner base particles onto which the dispersion stabilizer is not adsorbed, and contact these surfaces. At this time, the surfaces of the toner base particles are softened by heating at a temperature equal to or higher than the Tg of the toner base particle. The resin particles put into contact with the softened surfaces of the toner base particles adhere to the surfaces of the toner base particles. A longer heating at a temperature equal to or higher than the Tg of the toner base particle can attain stronger adhesion to enhance the tight adhesion between the toner base particles and the resin particles. If the resin particles fully cover the exposed surfaces of the toner base particles and excess resin particles are present, the particles are heated at a temperature equal to or higher than the Tg of the resin particle to smoothly fuse the resin particles adhering to the dispersion stabilizer to each other, enhancing tight adhesion of the resin particles. This enhanced tight adhesion can attain high durability. To reduce aggregates and enhance production stability more significantly, an additional dispersion stabilizer can be separately added. Alternatively, a small amount of a surfactant can also be added.

After step (iv), the dispersion stabilizer is removed at a temperature lower than the Tg of the resin particle. Subsequently, the particles are filtered, are washed, and are dried by known methods to prepare toner particles.

The toner particles may contain a fluidity improver as an external additive. Examples of the fluidity improver include fluorine resin powders such as vinylidene fluoride fine powders and polytetrafluoroethylene fine powders; silica fine powders such as silica fine powders prepared by a wet method and silica fine powders prepared by a dry method; treated silica fine powders prepared by surface treating these silica fine powders with a treatment agent such as a silane coupling agent, a titanium coupling agent or a silicone oil; titanium oxide fine powders; alumina fine powders; treated titanium oxide fine powders; and treated alumina oxide fine powders. A fluidity improver having a specific surface area of 30.0 $m^2/g$ or more, preferably 50.0 $m^2/g$ or more determined by nitrogen adsorption according to a BET method can attain favorable results. The fluidity improver is added in an amount of preferably 0.010 parts by mass or more and 8.0 parts by mass or less, more preferably 0.10 parts by mass or more and 4.0 parts by mass or less relative to 100 parts by mass of toner particles.

The toner has a weight average particle diameter (D4) of preferably 3.0 μm or more and 15.0 μm or less, more preferably 4.0 μm or more and 12.0 μm or less to develop microfine dots of a latent image as close as possible. The ratio (D4/D1) of the weight average particle diameter (D4) to the number average particle diameter (D1) can be less than 1.40.

The toner according to the present invention can also be used as a two-component developer in the form of a mixture with a magnetic carrier. Examples of usable magnetic carriers include metal particles having oxidized or unoxidized surfaces and including iron, lithium, calcium, magnesium, nickel, copper, zinc, cobalt, manganese, chromium and rare earth elements; particles of alloys thereof; and fine particles of particles of oxides and ferrite.

In a developing method of applying an AC bias to a developing sleeve, a coating carrier including a magnetic carrier core having a surface coated with a resin can be used. Examples of usable coating methods include a method for dissolving or suspending a coating material such as a resin in a solvent to prepare a coating solution, and applying the coating solution to the surface of the magnetic carrier core; and a method for mixing a powdery magnetic carrier core with a powdery coating material.

Examples of the coating material for the magnetic carrier core include silicone resins, polyester resins, styrene resins, acrylic resins, polyamides, poly(vinyl butyral) and aminoacrylate resins. These are used singly or in combination. The carrier core particles are treated with the coating material in an amount of preferably 0.10% by mass or more and 30% by mass or less, more preferably 0.50% by mass or more and 20% by mass or less relative to the carrier core particles. The magnetic carrier has an average particle diameter, i.e., a volume-based 50% particle diameter (D50) of preferably 10.0 μm or more and 100 μm or less, more preferably 20.0 μm or more and 70.0 μm or less.

In preparation of the two-component developer, the toner is mixed with a developer in a proportion of preferably 2.0% by mass or more and 15% by mass or less, more preferably 4.0% by mass or more and 13% by mass or less.

The methods of the measurements used in the present invention will now be described.

<Glass Transition Temperature>

The glass transition temperatures (Tg) of the toner and the resin particle can be determined with a differential scanning calorimeter (Q1000) manufactured by TA Instruments-Waters LLC, for example, by the following procedure.

First, a sample (6 mg) is precisely weighed, and is placed in an aluminum pan. An empty aluminum pan is prepared as a reference. Under a nitrogen atmosphere, the measurement is performed under conditions of temperature range for measurement: 20° C. or higher and 150° C. or lower, temperature raising rate: 2° C./min, modulation amplitude: ±0.6° C. and frequency: 1/min.

From the reversing heat flow curve created by the measurement during raising of the temperature, tangents from a curve indicating endotherm to the baselines before and after the endotherm are drawn, and the midpoint of a straight line connecting the points of intersection of the respective tangents is determined. The midpoint is defined as the glass transition temperature.

<Particle Diameters of Toner Particle>

The weight average particle diameter (D4) and the number average particle diameter (D1) of the toner are calculated as follows. A measurement apparatus used is a precise particle size distribution measurement apparatus "Coulter Counter Multisizer 3" (registered trademark, manufactured by Beckman Coulter, Inc.) equipped with an aperture tube of 100 μm in which the measurement is performed by a pore electric resistance method. Setting of measurement conditions and analysis of data from the measurement are performed with the attached, dedicated software "Beckman Coulter Multisizer 3 Version 3.51" (manufactured by Beckman Coulter, Inc.). The measurement is performed at 25000 effective measurement channels.

The electrolysis aqueous solution usable in the measurement is a 1% by mass solution of super grade sodium chloride dissolved in ion exchange water, such as "ISOTON II" (manufactured by Beckman Coulter, Inc.).

Before the measurement and the analysis are performed, the dedicated software was set as follows.

In a "Change standard measurement method (SOMME)" screen, the total count number in the control mode is set at 50000 particles, the number of measurements is set at 1, and the Kd value is set at a value determined with "Standard particle 10.0 μm" (manufactured by Beckman Coulter, Inc.) with the dedicated software. A "button for measurement of threshold/noise level" is pressed to automatically set the threshold and the noise level. The current is set at 1600 μA, the gain is set at 2, and the electrolyte solution is set at ISOTON II. "Flash aperture tube after measurement" is checked.

In a "Setting in conversion from pulse to particle diameter" screen, the bin interval is set to Logarithmic particle diameter, the particle diameter bin is set at 256 particle diameter bins, and the range of the particle diameter is set from 2 μm to 60 μm with the dedicated software.

The specific measurement is performed as follows.

(1) The electrolysis aqueous solution (200 mL) is placed in a 250 mL round-bottomed glass beaker dedicated to Multisizer 3. The beaker is placed on a sample stand, and the solution is stirred with a stirrer rod rotating counterclockwise at 24 rotations/sec. Dirt and air bubbles in the aperture tube are removed by the "Flash aperture" function of the dedicated software.

(2) The electrolysis aqueous solution (30 mL) is placed in a 100 mL flat-bottomed glass beaker. A diluted solution (0.3 mL) of "CONTAMINON N" (aqueous solution of 10% by mass neutral detergent (pH: 7) for washing a precise measurement apparatus including a nonionic surfactant, an anionic surfactant and an organic builder, manufactured by Wako Pure Chemical Industries, Ltd.) diluted 3 by mass times with ion exchange water is placed in the beaker as a dispersant.

(3) An ultrasonic disperser "Ultrasonic Dispersion System Tetra 150" (manufactured by Nikkaki Bios Co., Ltd.) is prepared. The ultrasonic disperser has an electrical output of 120 W and includes two incorporated oscillators having an oscillating frequency of 50 kHz with the phase of one oscillator being shifted 180° from the phase of the other oscillator. Ion exchange water (3.3 L) is placed in a water bath of the ultrasonic disperser, and CONTAMINON N (2 mL) is placed in the water bath.

(4) The beaker in (2) is set to a beaker fixing hole of the ultrasonic disperser to operate the ultrasonic disperser. The height of the beaker is adjusted so as to maximize the resonant state of the surface of the electrolysis aqueous solution in the beaker.

(5) While the electrolysis aqueous solution in the beaker in (4) is irradiated with ultrasonic waves, the toner (10 mg) is added little by little to the electrolysis aqueous solution, and is dispersed. The ultrasonic dispersion is continued for another 60 seconds. During the ultrasonic dispersion, the temperature of water in the water bath is appropriately adjusted to 10° C. or higher 40° C. or lower.

(6) The electrolytic aqueous solution having the dispersed toner (5) is added dropwise to the round-bottomed beaker set on the sample stand in (1) with a pipette, and the concentration for measurement is adjusted to 5%. The measurement is performed until the number of particles measured reaches 50000.

(7) The data measured is analyzed with the dedicated software attached to the analyzer, and the weight average particle diameter (D4) and the number average particle diameter (D1) are calculated. When graph/volume % is set with the dedicated software, the "Average diameter" on the "Analysis/volume statistical value (arithmetic average)" screen indicates the weight average particle diameter (D4). When graph/number % is set with the dedicated software, the "Average diameter" on the "Analysis/number statistical value (arithmetic average)" screen indicates the number average particle diameter (D1).

<Volume-Based D50 of Resin Particles>

The volume-based median particle size (D50) of resin particles is calculated from particle diameters measured with Zetasizer Nano-ZS (manufactured by Malvern Instruments Ltd.) by dynamic light scattering (DLS).

First, the apparatus is turned on, and the laser is allowed 30 minutes to stabilize. Zetasizer software is then activated.

"Manual" is selected from "Measure" menu, and measuring details are input as follows:

Measurement mode: particle diameter

Material: Polystyrene latex (RI: 1.59, Absorption: 0.01)

Dispersant: Water (Temperature: 25° C., Viscosity: 0.8872 cP, RI: 1.330)

Temperature: 25.0° C.

Cell: Clear disposable zeta cell

Measurement duration: Automatic

A sample is diluted with water to prepare a 0.50% by mass of sample. The sample is charged into a disposable capillary cell (DTS1060), and the cell is mounted on the cell holder of the apparatus.

If ready, "Start" button on a measurement display screen is pressed to start measurement.

D50 is calculated from data on the volume-based particle size distribution converted from the light intensity distribution, which is determined by the DLS measurement, by Mie theory.

<Acid Value>

The acid value indicates the amount of potassium hydroxide (mg) needed to neutralize an acid contained in 1 g of a sample. In the present invention, the acid value is measured according to JIS K 0070-1992, specifically according to the following procedure.

Titration is performed with a 0.1 mol/L potassium hydroxide ethyl alcohol solution (manufactured by KISHIDA CHEMICAL Co., Ltd.). The factor of the potassium hydroxide ethyl alcohol solution can be determined with a potentiometric titrator (potentiometric titrator AT-510 manufactured by Kyoto Electronics Manufacturing Co., Ltd.). A 0.100 mol/L hydrochloric acid (100 mL) is placed in a 250 mL tall beaker, and is titrated with the potassium hydroxide ethyl alcohol solution. The factor thereof is determined from the amount of the potassium hydroxide ethyl alcohol solution needed for neutralization. The 0.100 mol/L hydrochloric acid used is produced according to JIS K 8001-1998.

The acid value is measured under the following measurement conditions:

Titrator: potentiometric titrator AT-510 (manufactured by Kyoto Electronics Manufacturing Co., Ltd.)

Electrode: composite glass electrode double-junction type (manufactured by Kyoto Electronics Manufacturing Co., Ltd.)

Software for controlling titrator: AT-WIN

Titration analysis software: Tview

During titration, titration parameters and control parameters are set as follows:

Titration parameters

Titration mode: blank titration

Titration method: whole titration

Maximum amount of titration: 20 mL

Waiting time before titration: 30 seconds
Titration direction: automatic
Control parameters
Potential at determination of end point: 30 dE
Potential value at determination of end point: 50 dE/dmL
Determination of detection of end point: not set
Control rate mode: standard
Gain: 1
Potential at collection of data: 4 mV
Amount of titration at collection of data: 0.1 mL
Main Test;

A sample for measurement (0.100 g) is precisely weighed, and is placed in a 250 mL tall beaker. A mixed solution (150 mL) of toluene/ethyl alcohol (3:1) is added to dissolve the sample over one hour. The sample is titrated with the potassium hydroxide ethyl alcohol solution using the potentiometric titrator.

Blank Test;

The titration is performed by the same operation as above without using the sample (namely, with using only a mixed solution of toluene/ethyl alcohol (3:1)).

The results are substituted into the following formula to calculate the acid values.

$$A=[(C-B)\times f\times 5.611]/S$$

where A represents an acid value (mgKOH/g), B represents the amount of the potassium hydroxide ethyl alcohol solution to be added (mL) in the blank test, C represents the amount of the potassium hydroxide ethyl alcohol solution to be added (mL) in the main test, f represents the factor of the potassium hydroxide solution, and S represents the sample (g).

<pKa>

A sample for measurement (0.100 g) is precisely weighed, and is placed in a 250 mL tall beaker. THF (150 mL) is added to dissolve the sample over 30 minutes. A pH electrode is placed in the solution to read the pH of the THF solution of the sample. Every time when a 0.1 mol/L potassium hydroxide ethyl alcohol solution (manufactured by KISHIDA CHEMICAL Co., Ltd.) is added in an amount of 10 μL, the pH of the solution is read, and titration is performed. The 0.1 mol/L potassium hydroxide ethyl alcohol solution is added until the pH reaches 10 or more and the pH no longer changes by further addition of 30 μL of the 0.1 mol/L potassium hydroxide ethyl alcohol solution. From the result, the pH is plotted against the amount of the 0.1 mol/L potassium hydroxide ethyl alcohol solution added to produce a titration curve. In the titration curve, the point having the largest inclination of change in pH is defined as a point of neutralization. pKa is determined as follows. The pH in the titration with a half of the amount of the 0.1 mol/L potassium hydroxide ethyl alcohol solution needed to reach the point of neutralization is read from the titration curve, and this read pH value is defined as pKa.

<NMR>

The content of the monovalent group a contained in the resin A is determined by nuclear magnetic resonance spectroscopy ($^1$H-NMR) [400 MHz, $CDCl_3$, room temperature (25° C.)].

Measurement apparatus: FT NMR apparatus JNM-EX400 (manufactured by JEOL Ltd.)

Frequency: 400 MHz
Pulse condition: 5.0 μs
Frequency range: 10500 Hz
The number of integrations: 64 times From the integrated value of the spectrum, the molar ratio of the monomer components is determined. From the molar ratio, the content (mol %) of the monovalent group a contained in the resin A is calculated. The molar number of the group a per gram of the resin A is calculated.

<Molecular weight of resin A>

The molecular weight of resin A is calculated in terms of polystyrene by gel permeation chromatography (GPC). The elution rate of the polymer having a sulfonate group in a column also depends on the amount of the sulfonate group. Accordingly, a precise molecular weight and molecular weight distribution cannot be determined only from the measurement of the polymer by GPC. For this reason, a sample having a capped sulfonate group should be preliminarily prepared. Capping can be methyl esterification. A commercially available methyl esterifying agent can be used. Specifically, examples include a method for treating a sulfonate group with trimethylsilyldiazomethane.

In GPC, the molecular weight is measured by the following procedure. The resin is added to tetrahydrofuran (THF), and the solution is left to stand at room temperature for 24 hours. The solution is filtered through a solvent-resistant membrane filter "MAISHORI DISK" (manufactured by Tosoh Corporation) having a pore diameter of 0.2 μm to prepare a sample solution. The sample solution is measured under the following condition. In the preparation of the sample, the amount of THF is adjusted such that the concentration of the resin is 0.8% by mass. If the resin is barely dissolved in THF, a basic solvent such as DMF can also be used.

Apparatus: HLC8120 GPC (detector: RI) (manufactured by Tosoh Corporation)

Column: 7 columns of Shodex KF-801, 802, 803, 804, 805, 806 and 807 connected in series (manufactured by Showa Denko K.K.)

Eluent: tetrahydrofuran (THF)
Flow rate: 1.0 mL/min
Oven temperature: 40.0° C.

Amount of sample to be injected: molecular weight calibration curves produced with standard polystyrene resin columns listed below are used in calculation of the molecular weight of a sample (0.10 mL). Specifically, these are trade names "TSK Standard polystyrenes F-850, F-450, F-288, F-128, F-80, F-40, F-20, F-10, F-4, F-2, F-1, A-5000, A-2500, A-1000 and A-500" manufactured by Tosoh Corporation.

<Amount of metal>

The elements are measured with fluorescent X-rays according to JIS K 0119-1969, specifically, by the following procedure.

The amount of the dispersion stabilizer contained in the toner particles is determined with fluorescent X-rays if an inorganic dispersant is used. The amount of the inorganic dispersant is determined with fluorescent X-rays according to JIS K 0119-1969, specifically, by the following procedure.

The measurement apparatus used is a wavelength dispersion fluorescent X-ray analyzer "Axios" (manufactured by PANalytical B.V.) together with the attached dedicated software "SuperQ ver. 4.0F" (manufactured by PANalytical B.V.) for setting measurement conditions and analyzing measurement data. Rh is used for the anode in the X-ray tube. The measurement is performed in vacuum, the measurement diameter (collimator mask diameter) is 27 mm, and the measurement time is 10 seconds. Detection is performed using a proportional counter (PC) when a light element is measured, and using a scintillation counter (SC) when a heavy element is measured.

A sample for measurement to be used is a pellet produced as follows: a toner particle (4 g) is placed in a dedicated aluminum ring for press, and is made flat; using a tablet molding press machine "BRE-32" (manufactured by Maekawa Testing Machine Mfg. Co., LTD.), pressure is applied to the toner particle at 20 MPa for 60 seconds to mold the toner particle into a pellet having a thickness of 2 mm and a diameter of 39 mm.

Measurement is performed under the condition above. From the obtained peak position of the X-ray, the element is identified. The concentration of the element is calculated from the counting rate (unit: cps), which is the number of X-ray photons per unit time.

The amount of the metal element is determined using the measurement result and a calibration curve created in advance for the metal element that undergoes determination.

EXAMPLES

The present invention will now be specifically described by way of Examples, but the present invention will not be limited to these Examples. "Parts" indicate "parts by mass."

<Synthetic Example of Polymerizable Monomer M-1>

(Step 1)

2,5-Dihydroxybenzoic acid (100 g) and 80% sulfuric acid (1441 g) were heated to 50° C., and were mixed. tert-Butyl alcohol (144 g) was added to the dispersion liquid, and was stirred at 50° C. for 30 minutes. The operation, i.e., addition of tert-butyl alcohol (144 g) to the dispersion liquid followed by stirring for 30 minutes was then performed three times. The reaction solution was cooled to room temperature, and was slowly poured to ice water (1 kg). The precipitate was filtered, and was washed with water, then with hexane. The precipitate was dissolved in methanol (200 mL), and was reprecipitated in water (3.6 L). After filtration, the reaction product was dried at 80° C. to prepare a salicylic acid intermediate product (74.9 g) represented by formula (4).

Formula (4)

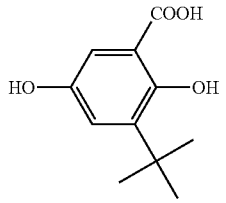

(Step 2)

The salicylic acid intermediate product (25.0 g) was dissolved in methanol (150 mL). Potassium carbonate (36.9 g) was added, and was heated to 65° C. A mixed solution of 4-(chloromethyl)styrene (18.7 g) and methanol (100 mL) was added dropwise to the reaction solution to perform a reaction at 65° C. for three hours. The reaction solution was cooled, and was filtered. The filtrate was condensed to prepare a crude product. The crude product was dispersed in water (1.5 L) at pH=2, and ethyl acetate was added for extraction. The extracted product was washed with water, and was dried with magnesium sulfate. Ethyl acetate was distilled off under reduced pressure to prepare a precipitate. The precipitate was washed with hexane, and was recrystallized with toluene and ethyl acetate to be purified. Polymerizable monomer M-1 (20.1 g) represented by formula (5) was prepared.

Formula (5)

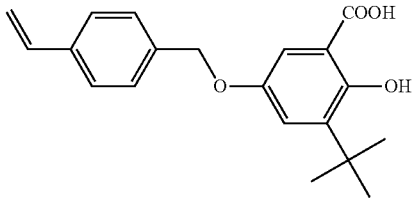

<Synthetic Example of Polymerizable Monomer M-2>

Polymerizable monomer M-2 represented by formula (6) was prepared by the same method as in Synthesis of Polymerizable monomer M-1 (Step 2) except that the salicylic acid intermediate product represented by formula (4) was replaced by 2,4-dihydroxybenzoic acid (18 g).

Formula (6)

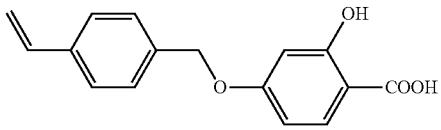

<Synthetic Example of Polymerizable Monomer M-3>

Polymerizable monomer M-3 represented by formula (7) was prepared by the same method as in Synthesis of Polymerizable monomer M-1 (Step 2) except that the salicylic acid intermediate product represented by formula (4) was replaced by 2,3-dihydroxybenzoic acid (18 g).

Formula (7)

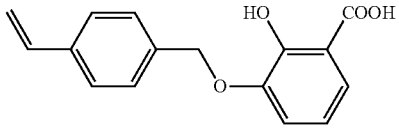

<Synthetic Example of Polymerizable Monomer M-4>

Polymerizable monomer M-4 represented by formula (8) was prepared by the same method as in Synthesis of Polymerizable monomer M-1 (Step 2) except that the salicylic acid intermediate product represented by formula (4) was replaced by 2,6-dihydroxybenzoic acid (18 g).

Formula (8)

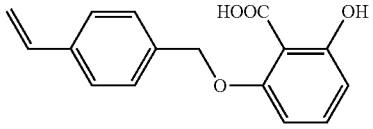

<Synthesis Example of Polymerizable Monomer M-5>

A salicylic acid intermediate product was prepared by the same method as in Synthesis of Polymerizable monomer M-1 (step 1) except that tert-butyl alcohol (144 g) was replaced by 2-octanol (253 g). Polymerizable monomer M-5 represented by Formula (9) was prepared by the same method as in Synthesis of Polymerizable monomer M-1 (step 2) except that the salicylic acid intermediate product (32 g) was used.

Formula (9)

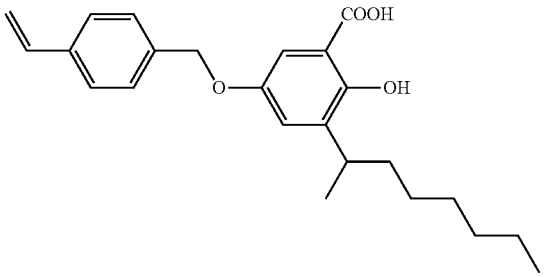

<Synthesis Example of Polymerizable Monomer M-6>

Polymerizable monomer M-6 represented by Formula (10) was prepared by the same method as in Synthesis of Polymerizable monomer M-1 (step 2) except that the salicylic acid intermediate product represented by Formula (4) was replaced by 2,5-dihydroxy-3-methoxybenzoic acid (22 g).

Formula (10)

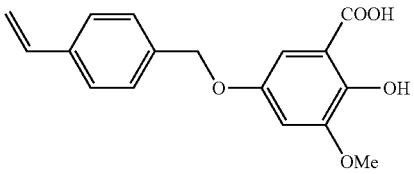

<Synthetic Example of Resin A-1>

Polymerizable monomer M-1 (9.0 g) represented by formula (5), 2-ethylhexyl acrylate (15.2 g), and styrene (45.8 g) were dissolved in DMF (42.0 mL), and were stirred for one hour while nitrogen gas was being bubbled. The solution was heated to 110° C. An initiator or a mixed solution of tert-butyl peroxyisopropyl monocarbonate (manufactured by NOF Corporation, trade name: Perbutyl I, 2.1 g) and toluene (42 mL) was added dropwise to the reaction solution. The reaction solution was further reacted at 110° C. for four hours. The reaction solution was then cooled, and was added dropwise to methanol (1 L) to prepare a precipitate. The precipitate was dissolved in THF (120 mL). The solution was added dropwise to methanol (1.80 L) to precipitate a white precipitate. The white precipitate was filtered, and was dried under reduced pressure at 90° C. to prepare Resin A-1 (57.6 g). Resin A-1 was measured by NMR and the acid value thereof was determined to determine the content of the component derived from Polymerizable monomer M-1.

<Synthetic Examples of Resins A-2 to A-17>

Resins A-2 to A-17 were prepared in the same manner as in Synthetic Example of Resin A-1 except that the amounts of raw materials used were varied as shown in Table 2.

<Synthetic Example of Resin D-1>

Xylene (200 parts) was placed in a reaction container equipped with a stirrer, a condenser, a thermometer and a nitrogen inlet pipe, and was refluxed under a nitrogen stream. The following monomers, i.e., 2-acrylamide-2-methylpropanesulfonic acid (6.0 parts), styrene (72.0 parts), and 2-ethylhexyl acrylate (18.0 parts)

were mixed, and were added dropwise into the reaction container with stirring. The solution was kept for 10 hours. Subsequently, the solvent was distilled off by distillation, and the resultant was dried under reduced pressure at 40° C. to prepare Resin D-1. Resin D-1 was measured by NMR and the acid value thereof was determined to determine the content of the monovalent group a represented by Formula (1).

<Synthesis Example of Resin D-2>

Xylene (200 parts) was placed in a reaction container equipped with a stirrer, a condenser, a thermometer and a nitrogen inlet pipe, and was refluxed under a nitrogen stream.

Next, 5-vinylsalicylic acid (9.0 parts), styrene (75.0 parts), 2-ethylhexyl acrylate (16.0 parts) and dimethyl-2,2'-azobis(2-methyl propionate) (5.0 parts)

were mixed, and were added dropwise in the reaction container with stirring. The solution was kept for 10 hours. The solvent was then distilled off by distillation, and the resultant was dried under reduced pressure at 40° C. to prepare Resin D-2. Resin D-2 was measured by NMR and the acid value thereof was determined to determine the content of the component derived from the content of the monovalent group a represented by Formula (1).

The physical properties of Resin A-1 to Resin A-17, Resin D-1 and Resin D-2 are shown in Table 2. In the table, St indicates "styrene," 2EHA indicates "2-ethylhexyl acrylate, BA indicates "n-butyl acrylate," and HEMA indicates "2-hydroxyethyl methacrylate."

TABLE 2

| | Polymerizable monomer M | | | | | | | Weight average | | Content of monovalent group a represented by | Acid |
|---|---|---|---|---|---|---|---|---|---|---|---|
| | Type | Amount added (g) | St | 2EHA | BA | HEMA | Initiator | molecular weight (Mw) | Tg (° C.) | structural formula (1) (μmol/g) | dissociation constant pKa |
| Resin A-1 | Polymerizable monomer M-1 | 9.0 | 45.8 | 15.2 | 0.0 | 0.0 | 2.1 | 28700 | 69.5 | 421 | 7.1 |
| Resin A-2 | Polymerizable monomer M-2 | 7.6 | 46.9 | 15.5 | 0.0 | 0.0 | 2.1 | 29600 | 70.2 | 439 | 7.3 |
| Resin A-3 | Polymerizable monomer M-3 | 7.6 | 46.9 | 15.5 | 0.0 | 0.0 | 2.1 | 29400 | 69.8 | 402 | 7.7 |
| Resin A-4 | Polymerizable monomer M-4 | 7.6 | 46.9 | 15.5 | 0.0 | 0.0 | 2.1 | 30300 | 71.3 | 424 | 7.8 |
| Resin A-5 | Polymerizable monomer M-5 | 10.3 | 44.8 | 14.9 | 0.0 | 0.0 | 2.1 | 31200 | 72.1 | 405 | 7.3 |
| Resin A-6 | Polymerizable monomer M-6 | 8.3 | 46.3 | 15.4 | 0.0 | 0.0 | 2.1 | 30100 | 70.5 | 397 | 8.0 |

TABLE 2-continued

| | Polymerizable monomer M | | | | | | | Weight average | | Content of monovalent group a represented by | Acid |
|---|---|---|---|---|---|---|---|---|---|---|---|
| | Type | Amount added (g) | St | 2EHA | BA | HEMA | Initiator | molecular weight (Mw) | Tg (° C.) | structural formula (1) (μmol/g) | dissociation constant pKa |
| Resin A-7 | Polymerizable monomer M-2 | 8.2 | 50.3 | 0.0 | 11.6 | 0.0 | 2.1 | 30300 | 83.2 | 463 | 7.0 |
| Resin A-8 | Polymerizable monomer M-2 | 8.4 | 61.6 | 0.0 | 0.0 | 0.0 | 4.2 | 16800 | 85.7 | 453 | 7.2 |
| Resin A-9 | Polymerizable monomer M-2 | 8.3 | 58.5 | 0.0 | 0.0 | 3.2 | 4.2 | 15600 | 85.2 | 432 | 7.5 |
| Resin A-10 | Polymerizable monomer M-2 | 8.0 | 46.5 | 0.0 | 0.0 | 15.5 | 4.2 | 16800 | 86.3 | 417 | 8.5 |
| Resin A-11 | Polymerizable monomer M-2 | 1.6 | 52.0 | 16.4 | 0.0 | 0.0 | 2.1 | 32100 | 72.1 | 60 | 7.4 |
| Resin A-12 | Polymerizable monomer M-2 | 0.8 | 52.7 | 16.5 | 0.0 | 0.0 | 2.1 | 29700 | 70.8 | 43 | 7.2 |
| Resin A-13 | Polymerizable monomer M-2 | 3.9 | 50.0 | 16.1 | 0.0 | 0.0 | 2.1 | 30200 | 71.4 | 208 | 7.2 |
| Resin A-14 | Polymerizable monomer M-2 | 10.4 | 44.5 | 15.1 | 0.0 | 0.0 | 2.1 | 33200 | 72.0 | 555 | 7.3 |
| Resin A-15 | Polymerizable monomer M-2 | 14.2 | 41.2 | 14.6 | 0.0 | 0.0 | 2.1 | 29600 | 70.1 | 944 | 7.5 |
| Resin A-16 | Polymerizable monomer M-2 | 17.9 | 38.1 | 14.0 | 0.0 | 0.0 | 2.1 | 29700 | 71.0 | 1004 | 7.6 |
| Resin A-17 | Polymerizable monomer M-2 | 9.2 | 60.8 | 0.0 | 0.0 | 0.0 | 2.1 | 31200 | 105.0 | 477 | 7.3 |
| Resin D-1 | | Described in the specification | | | | | | 24500 | 68.9 | 0 | −0.6 |
| Resin D-2 | | Described in the specification | | | | | | 14400 | 75.2 | 0 | 6.6 |

<Production Example of Aqueous Dispersion of Resin Particle E-1>

Methyl ethyl ketone (200.0 parts) was placed in a reaction container equipped with a stirrer, a condenser, a thermometer and a nitrogen inlet pipe, and Resin A-1 (100.0 parts) was added, and was dissolved. A 1.0 mol/L potassium hydroxide aqueous solution was slowly added, and was stirred for 10 minutes. Ion exchange water (500.0 parts) was slowly added dropwise to emulsify the solution. The emulsified product was distilled under reduced pressure to remove the solvent, and ion exchange water was added to adjust the concentration of the resin to 20%. An aqueous dispersion of Resin particle E-1 was prepared. The physical properties of the aqueous dispersion of Resin particle A are shown in Table 3.

<Production Examples of Aqueous Dispersions of Resin Particles E-2 to E-19>

Aqueous dispersions of Resin particles E-2 to E-19 were prepared in the same manner as in Production Example of Resin particle E-1 except that Resin A-1 was replaced by another polymer and the amount of the 1.0 mol/L potassium hydroxide aqueous solution was varied as shown in Table 3. The physical properties of the aqueous dispersions of Resin particles E-1 to E-19 are shown in Table 3.

TABLE 3

| Aqueous dispersion | Type of resin | KOH content (parts by mass) | Particle diameter D50 (nm) |
|---|---|---|---|
| Resin particle E-1 | Resin A-1 | 39.7 | 66 |
| Resin particle E-2 | Resin A-2 | 41.5 | 72 |
| Resin particle E-3 | Resin A-3 | 37.9 | 96 |
| Resin particle E-4 | Resin A-4 | 40.1 | 58 |
| Resin particle E-5 | Resin A-5 | 38.2 | 63 |
| Resin particle E-6 | Resin A-6 | 37.5 | 82 |
| Resin particle E-7 | Resin A-7 | 43.7 | 52 |

TABLE 3-continued

| Aqueous dispersion | Type of resin | KOH content (parts by mass) | Particle diameter D50 (nm) |
|---|---|---|---|
| Resin particle E-8 | Resin A-8 | 42.8 | 61 |
| Resin particle E-9 | Resin A-9 | 40.8 | 64 |
| Resin particle E-10 | Resin A-10 | 39.4 | 73 |
| Resin particle E-11 | Resin A-11 | 8.9 | 95 |
| Resin particle E-12 | Resin A-12 | 4.5 | 86 |
| Resin particle E-13 | Resin A-13 | 21.8 | 71 |
| Resin particle E-14 | Resin A-14 | 49.2 | 65 |
| Resin particle E-15 | Resin A-15 | 67.2 | 53 |
| Resin particle E-16 | Resin A-16 | 75.3 | 48 |
| Resin particle E-17 | Resin A-17 | 45.1 | 50 |
| Resin particle E-18 | Resin D-1 | 35.4 | 56 |
| Resin particle E-19 | Resin D-2 | 49.9 | 72 |

Synthesis Example of Polar Resin F

Methyl ethyl ketone (100.0 parts) was placed in a reaction container equipped with a stirrer, a condenser, a thermometer and a nitrogen inlet pipe, and was heated to a temperature of 80° C. under a nitrogen atmosphere. t-Butylperoxy-2-ethylhexanoate (3.0 parts) as a polymerization initiator was then added to a mixture of the following monomers, and the mixture was added dropwise over two hours with stirring:

styrene (72.2 parts)

n-butyl acrylate (14.0 parts)

2-hydroxyethyl methacrylate (4.0 parts)

Next, a polymerization reaction was performed for 10 hours while the temperature was kept. After cooling, the reaction solution was added dropwise to and reprecipitated in hexane for purification, was filtered, and was dried to prepare Polar resin F. Polar resin F had an acid value derived from carboxy groups of 0 mgKOH/g.

Example 1

Preparation of Toner Base Particles

A 0.1 mol/L $Na_3PO_4$ aqueous solution (850.0 parts) was placed in a container equipped with a high-speed stirrer Clearmix (manufactured by M Technique Co., Ltd.). The number of rotations was adjusted to 15000 rpm, and the container was heated to 60° C. A 1.0 mol/L $CaCl_2$ aqueous solution (68.0 parts) was added thereto to prepare an aqueous medium containing a fine, poorly water-soluble dispersant $Ca_3(PO_4)_2$. After stirring for 30 minutes, the pH was adjust to 6.0.

The materials listed below were dissolved at 100 r/min using a propeller type stirrer to prepare a dissolution solution.

styrene (70.0 parts)

n-butyl acrylate (30.0 parts)

saturated polyester resin (3.0 parts)

(terephthalic acid-propylene oxide modified bisphenol A copolymer, acid value: 13 mgKOH/g, Mw: 14500)

Next, the materials listed below were added to the dissolution solution:

C.I. Pigment Blue 15:3 (6.5 parts)

ester wax (12.0 parts)

(main component: $C_{21}H_{43}COOC_{22}H_{45}$, melting point: 72.5° C.)

The mixed solution was heated to a temperature of 60° C., and was stirred with a TK homomixer (manufactured by PRIMIX Corporation) at 9000 r/min, dissolved, and dispersed.

A polymerization initiator 2,2'-azobis(2,4-dimethylvaleronitrile) (10.0 parts) was dissolved in this dissolution solution to prepare a polymerizable monomer composition. The polymerizable monomer composition was added to the aqueous medium, and was granulated at a temperature of 60° C. for 15 minutes while Clearmix was operated at 15000 rpm.

The product was placed in a propeller type stirrer, and while being stirred at 100 rpm, the product was reacted at a temperature of 70° C. for five hours. The product was then heated to a temperature of 80° C. to be reacted for another five hours.

Next, ion exchange water (200.0 parts) was added. The refluxing pipe was detached, and a distillator was attached. Distillation was performed for five hours at an inner temperature of the container of 100° C. The distillation fraction was 700.0 parts. The temperature was lowered to 30° C. to prepare a polymer slurry. Ion exchange water was added to adjust the concentration of the polymer particle in the dispersion liquid to 20%. A dispersion liquid of toner base particles was prepared.

A small amount of the dispersion liquid of toner base particles was extracted, and 10% hydrochloric acid was added to control the pH to 1.0. The dispersion liquid was stirred for two hours, was filtered, was sufficiently washed with ion exchange water, and was dried. The glass transition temperature Tg of the product was measured. Tg was 50.3° C.

(Adhesion of resin particles)

The dispersion liquid of toner base particles (500.0 parts) (solid content: 100.0 parts) was placed in a reaction container equipped with a reflux cooling tube, a stirrer and a thermometer. A sodium carbonate aqueous solution was added with stirring, and the pH was controlled to 8.5 (adhesion pH). The aqueous dispersion of Resin particle E-1 (15.0 parts) (solid content: 3.0 parts) was slowly added to the solution at 22° C. (temperature during addition), and was stirred at 200 rotations/min for 15 minutes. The temperature of the dispersion liquid of toner base particles to which the resin particles applied was kept at 80° C. (temperature during heating) with an oil bath heater, and was continuously stirred for one hour. After the dispersion liquid was cooled to 20° C. (temperature during treatment with an acid), 10% hydrochloric acid was added to control the pH to 1.0, and the solution was stirred for two hours. The solution was filtered, and was washed with ion exchange water (treatment with an acid). The filtered cake was redispersed in ion exchange water, and 10% hydrochloric acid was added to control the pH to 1.0. The solution was stirred for two hours, and was filtered. The operation to redisperse and treat the filtered cake with an acid was repeated three times. Subsequently, the product was dried, and was classified to prepare Toner particle 1.

Hydrophobic silica fine powder (2.0 parts) was mixed with Toner particle 1 (100.0 parts) in a Henschel mixer (manufactured by NIPPON COKE & ENGINEERING CO., LTD.) at 3000 rpm for 15 minutes to prepare Toner 1. The hydrophobic silica fine powder used as a fluidity improver was treated with dimethylsilicone oil (20% by mass), and had the number average size of primary particles of 10 nm and a BET specific surface area of 170 $m^2/g$.

Examples 2 to 27

Toner 2 to 27 were prepared in the same manner as in Example 1 except that the pH, the type and amount of the aqueous dispersion of resin particles to be added, the temperature during addition of the aqueous dispersion of resin particles, and the temperature during heating were varied as shown in Table 4.

TABLE 4

| | | | Aqueous dispersion of resin particles | | | | |
|---|---|---|---|---|---|---|---|
| | | Adhesion pH pH | Type of resin fine particles | Amount added (parts by mass) | Solid content (parts by mass) | Temperature during addition (° C.) | Temperature during heating (° C.) |
| Example 1 | Toner 1 | 8.5 | E-1 | 15.0 | 3.0 | 22 | 80 |
| Example 2 | Toner 2 | 8.5 | E-2 | 15.0 | 3.0 | 22 | 80 |
| Example 3 | Toner 3 | 8.5 | E-3 | 15.0 | 3.0 | 22 | 80 |
| Example 4 | Toner 4 | 8.5 | E-4 | 15.0 | 3.0 | 22 | 80 |
| Example 5 | Toner 5 | 8.5 | E-5 | 15.0 | 3.0 | 22 | 80 |
| Example 6 | Toner 6 | 8.5 | E-6 | 15.0 | 3.0 | 22 | 80 |
| Example 7 | Toner 7 | 8.5 | E-7 | 15.0 | 3.0 | 22 | 90 |
| Example 8 | Toner 8 | 8.5 | E-8 | 15.0 | 3.0 | 22 | 90 |

TABLE 4-continued

| | | | Aqueous dispersion of resin particles | | | | |
|---|---|---|---|---|---|---|---|
| | | Adhesion pH pH | Type of resin fine particles | Amount added (parts by mass) | Solid content (parts by mass) | Temperature during addition (° C.) | Temperature during heating (° C.) |
| Example 9 | Toner 9 | 8.5 | E-9 | 15.0 | 3.0 | 22 | 90 |
| Example 10 | Toner 10 | 8.5 | E-10 | 15.0 | 3.0 | 22 | 90 |
| Example 11 | Toner 11 | 8.5 | E-11 | 15.0 | 3.0 | 22 | 80 |
| Example 12 | Toner 12 | 8.5 | E-12 | 15.0 | 3.0 | 22 | 80 |
| Example 13 | Toner 13 | 8.5 | E-13 | 15.0 | 3.0 | 22 | 80 |
| Example 14 | Toner 14 | 8.5 | E-14 | 15.0 | 3.0 | 22 | 80 |
| Example 15 | Toner 15 | 8.5 | E-15 | 15.0 | 3.0 | 22 | 80 |
| Example 16 | Toner 16 | 8.5 | E-16 | 15.0 | 3.0 | 22 | 80 |
| Example 17 | Toner 17 | 8.5 | E-2 | 0.5 | 0.1 | 22 | 80 |
| Example 18 | Toner 18 | 8.5 | E-2 | 1.5 | 0.3 | 22 | 80 |
| Example 19 | Toner 19 | 8.5 | E-2 | 2.5 | 0.5 | 22 | 80 |
| Example 20 | Toner 20 | 8.5 | E-2 | 5.0 | 1.0 | 22 | 80 |
| Example 21 | Toner 21 | 8.5 | E-2 | 10.0 | 2.0 | 22 | 80 |
| Example 22 | Toner 22 | 8.5 | E-2 | 25.0 | 5.0 | 22 | 80 |
| Example 23 | Toner 23 | 8.5 | E-2 | 15.0 | 3.0 | 50 | 80 |
| Example 24 | Toner 24 | 8.5 | E-2 | 15.0 | 3.0 | 70 | 80 |
| Example 25 | Toner 25 | 8.5 | E-2 | 15.0 | 3.0 | 80 | 80 |
| Example 26 | Toner 26 | 8.5 | E-17 | 2.5 | 0.5 | 22 | 80 |
| Example 27 | Toner 27 | 8.5 | E-17 | 2.5 | 0.5 | 22 | 45 |

Example 28

Resin A-1 was frozen, and was pulverized to prepare a freeze pulverized product of Resin A-1.

A dispersion liquid of toner base particles was prepared in the same manner as in Example 1. The dispersion liquid of toner base particles was controlled to a pH of 1.5. After the dispersion liquid was stirred as it was for two hours, filtration and washing with water were repeated three times. A solid content was then recovered, and was dried in a reduced pressure dryer at 30° C. for one day.

(Fine Particle Adhering Step)

The freeze pulverized product of Resin A-1 (3.0 parts) was added to the dried toner base particles (100.0 parts), and the mixture was placed in a dry particle composite apparatus (manufactured by Hosokawa Micron Corporation, Nobilta NOB-130). Adhesion was performed under conditions of a treatment temperature: 30° C. and a rate of a rotary blade: 90 m/sec to prepare Toner particle 28.

Hydrophobic silica fine powder (2.0 parts) was mixed with Toner particle 28 (100.0 parts) in a Henschel mixer (manufactured by NIPPON COKE & ENGINEERING CO., LTD.) at 3000 rpm for 15 minutes to prepare Toner 28. The hydrophobic silica fine powder used as a fluidity improver was treated with dimethylsilicone oil (20% by mass), and had the number average size of primary particles of 10 nm and a BET specific surface area of 170 $m^2/g$.

Example 29

An aqueous dispersion of Resin particle E-1 was dried to prepare a dried product of Resin particle E-1. The dried product of Resin particle E-1 was frozen, and was pulverized to prepare a freeze pulverized product of Resin particle E-1.

Toner 29 was prepared in the same manner as in Example 28 except that the freeze pulverized product of Resin A-1 was replaced by the freeze pulverized product of Resin particle E-1.

Example 30

A dispersion liquid of toner base particles was prepared in the same manner as in Example 1 before preparation of the toner base particles.

(Adhesion of Resin Particles)

The dispersion liquid of toner base particles (500.0 parts) (solid content: 100.0 parts) was placed in a reaction container equipped with a reflux cooling tube, a stirrer and a thermometer. A sodium carbonate aqueous solution was added with stirring, and the pH was controlled to 9.0 (adhesion pH). An aqueous dispersion of Resin particle E-2 (15.0 parts) (solid content: 3.0 parts) was slowly added to the solution at 22° C. (temperature during addition), and was stirred at 200 rotations/min for 15 minutes. The temperature of the dispersion liquid of toner base particles to which the resin particles applied was kept at 80° C. (temperature during heating) with an oil bath heater, and the dissolution solution was continuously stirred for one hour. After the dispersion liquid was cooled to 20° C., 10% hydrochloric acid was added to control the pH to 1.5 (pH in treatment with an acid), and the solution was stirred for two hours (time for treatment with an acid). The solution was filtered, and was sufficiently washed with ion exchange water. The product was dried, and was classified to prepare Toner particle 30.

Toner particle 30 underwent external addition of hydrophobic silica fine powder in the same manner as in Example 1 to prepare Toner 30.

Example 31

A dispersion liquid of toner base particles was prepared in the same manner as in Example 1 except that the 1.0 mol/L-$CaCl_2$ aqueous solution in (Preparation of toner base particles) in Example 1 was replaced by a 1.0 mol/L-$MgCl_2$ aqueous solution.

(Adhesion of Resin Particles)

The subsequent operation was performed in the same manner as in Example 30 to prepare Toner 31.

Example 32

A dispersion liquid of toner base particles was prepared in the same manner as in Example 1 except that the 1.0 mol/L-$CaCl_2$ aqueous solution in (Preparation of toner base particles) in Example 1 was replaced by a 1.0 mol/L-$BaCl_2$ aqueous solution.

(Adhesion of Resin Particles)

The subsequent operation was performed in the same manner as in Example 30 to prepare Toner 32.

Example 33

Preparation of Toner Base Particles

A dispersion liquid of toner base particles was prepared in the same manner as in Example 1 except that the 1.0 mol/L-$CaCl_2$ aqueous solution in (Preparation of toner base particles) in Example 1 was replaced by a 0.7 mol/L-$AlCl_3$ aqueous solution.

(Adhesion of Resin Particles)

The subsequent operation was performed in the same manner as in Example 30 to prepare Toner 33.

Example 34

Calcium chloride (13.2 parts) was dissolved in ion exchange water (250 parts) to prepare an aqueous solution, and the solution was placed in a container equipped with a high-speed stirrer Clearmix (manufactured by M Technique Co., Ltd.). The number of rotations was adjusted to 18000 rpm. Sodium hydroxide (4.8 parts) was dissolved in ion exchange water (50 parts) to prepare an aqueous solution, and this aqueous solution was gradually added to the container with stirring to prepare a calcium hydroxide colloid (poorly water-soluble metal hydroxide colloid) dispersion liquid. The pH was controlled to 6.0.

The materials listed below were dissolved with a propeller type stirrer at 100 rpm to prepare a dissolution solution:

styrene (70.0 parts)

n-butyl acrylate (30.0 parts)

saturated polyester resin (3.0 parts)

(terephthalic acid-propylene oxide-modified bisphenol A copolymer, acid value: 13 mgKOH/g, Mw: 14500)

Next, the materials listed below were added to the dissolution solution:

C.I. Pigment Blue 15:3 (6.5 parts)

ester wax (12.0 parts)

(main component: $C_{21}H_{43}COOC_{22}H_{45}$, melting point: 72.5° C.)

After the mixed solution was heated to a temperature of 60° C., the mixed solution was stirred with a TK homomixer (manufactured by PRIMIX Corporation) at 9000 r/min to be dissolved and dispersed.

A polymerization initiator 2,2'-azobis(2,4-dimethylvaleronitrile) (10.0 parts) was dissolved in the dispersion solution to prepare a polymerizable monomer composition. The polymerizable monomer composition was added to the aqueous medium, and was granulated at a temperature of 60° C. for 15 minutes while Clearmix was operated at 18000 rpm.

The product was placed in a propeller type stirrer. While being stirred at 100 rpm, the product was reacted at a temperature of 70° C. for five hours. The product was then heated to a temperature of 80° C. to be reacted for another five hours.

Next, ion exchange water (500.0 parts) was added. The refluxing pipe was detached, and a distillator was attached. Distillation was performed for five hours at an inner temperature of the container of 100° C. The distillation fraction was 500.0 parts. The temperature was lowered to 30° C. to prepare a polymer slurry. Ion exchange water was added to adjust the concentration of the polymer particle in the dispersion liquid to 20%. A dispersion liquid of toner base particles was prepared.

A small amount of the dispersion liquid of toner base particles was extracted, and 10% hydrochloric acid was added to control the pH to 1.0. The dispersion liquid was stirred for two hours, was filtered, was sufficiently washed with ion exchange water, and was dried. The glass transition temperature Tg was measured. Tg was 50.6° C.

(Adhesion of Resin Particles)

The subsequent operation was performed in the same manner as in Example 30 to prepare Toner 34.

Example 35

Toner 35 was prepared in the same manner as in Example 34 except that calcium chloride (13.2 parts) in Example 34 was replaced by magnesium chloride (11.3 parts).

Example 36

Toner 36 was prepared in the same manner as in Example 34 except that calcium chloride (13.2 parts) in Example 34 was replaced by barium chloride (24.7 parts).

Example 37

Toner 37 was prepared in the same manner as in Example 34 except that calcium chloride (13.2 parts) in Example 34 was replaced by aluminum chloride (10.5 parts).

Example 38

Sodium carbonate (12.6 parts) was dissolved in ion exchange water (250 parts) to prepare an aqueous solution, and the solution was placed in a container equipped with a high-speed stirrer Clearmix (manufactured by M Technique Co., Ltd.). The number of rotations was adjusted to 18000 rpm. Calcium chloride (13.2 parts) was dissolved in ion exchange water (50 parts) to prepare an aqueous solution, and this aqueous solution was added to the container at once with stirring. The mixed solution was stirred for 30 minutes. The pH was then controlled to 6.0.

The materials listed below were dissolved with a propeller type stirrer at 100 rpm to prepare a dissolution solution:

styrene (70.0 parts)

n-butyl acrylate (30.0 parts)

saturated polyester resin (3.0 parts)

(terephthalic acid-propylene oxide-modified bisphenol A copolymer, acid value: 13 mgKOH/g, Mw: 14500)

Next, the materials listed below were added to the dissolution solution:

C.I. Pigment Blue 15:3 (6.5 parts)

ester wax (12.0 parts)

(main component: $C_{21}H_{43}COOC_{22}H_{45}$, melting point: 72.5° C.)

After the mixed solution was heated to a temperature of 60° C., the mixed solution was stirred with a TK homomixer (manufactured by PRIMIX Corporation) at 9000 r/min to be dissolved and dispersed.

A polymerization initiator 2,2'-azobis(2,4-dimethylvaleronitrile) (10.0 parts) was dissolved in the dispersion solution to prepare a polymerizable monomer composition. The polymerizable monomer composition was added to the aqueous medium, and was granulated at a temperature of 60° C. for 15 minutes while Clearmix was operated at 18000 rpm.

The product was placed in a propeller type stirrer. While being stirred at 100 rpm, the product was reacted at a temperature of 70° C. for five hours. The product was then heated to a temperature of 80° C. to be reacted for another five hours.

Next, ion exchange water (500.0 parts) was added. The refluxing pipe was detached, and a distillator was attached. Distillation was performed for five hours at an inner temperature of the container of 100° C. The distillation fraction was 500.0 parts. The temperature was lowered to 30° C. to prepare a polymer slurry. Ion exchange water was added to adjust the concentration of the polymer particle in the dispersion liquid to 20%. A dispersion liquid of toner base particles was prepared.

A small amount of the dispersion liquid of toner base particles was extracted, and 10% hydrochloric acid was added to control the pH to 1.0. The dispersion liquid was stirred for two hours, was filtered, was sufficiently washed with ion exchange water, and was dried. The glass transition temperature Tg was measured. Tg was 50.3° C.

(Adhesion of Resin Particles)

The subsequent operation was performed in the same manner as in Example 30 to prepare Toner 38.

Example 39

Toner 39 was prepared in the same manner as in Example 38 except that calcium chloride (13.2 parts) in Example 38 was replaced by magnesium chloride (11.3 parts).

Example 40

Toner 40 was prepared in the same manner as in Example 38 except that calcium chloride (13.2 parts) in Example 38 was replaced by barium chloride (24.7 parts).

Example 41

Toner 41 was prepared in the same manner as in Example 38 except that calcium chloride (13.2 parts) in Example 38 was replaced by aluminum chloride (10.5 parts).

Examples 42 to 52

Toners 42 to 52 were prepared in the same manner as in Example 30 except that the adhesion pH, the pH in the treatment with an acid, and the time for the treatment with an acid in the resin particle adhering step in Example 30 were varied as shown in Table 5.

TABLE 5

| | Adhesion pH | pH in treatment with acid | Time for treatment with acid (h) |
|---|---|---|---|
| Example 42 | 7.5 | 1.0 | 2.0 |
| Example 43 | 7.5 | 1.5 | 2.0 |
| Example 44 | 8.0 | 1.5 | 2.0 |
| Example 45 | 8.5 | 1.0 | 2.0 |
| Example 46 | 8.5 | 2.0 | 2.0 |
| Example 47 | 8.5 | 2.5 | 2.0 |
| Example 48 | 8.5 | 3.0 | 2.0 |
| Example 49 | 8.5 | 3.5 | 2.0 |
| Example 50 | 9.0 | 2.0 | 1.0 |
| Example 51 | 9.0 | 3.0 | 1.0 |
| Example 52 | 9.0 | 3.5 | 0.5 |

Example 53

Toner 53 was prepared in the same manner as in Example 30 except that the saturated polyester resin in Example 30 was replaced by Polar resin F.

Example 54

Toner particle 54 was prepared in the same manner as in Example 1 except that the temperature during treatment with an acid in Example 1 was changed to 65° C. The toner particle was remarkably coarse, and was not used in the subsequent preparation of the toner and evaluation.

Example 55

A toner was produced by dissolution suspension according to the following procedure.

First, an aqueous medium and a dissolution solution were prepared by the following procedures, and a toner was prepared.

Water (660.0 parts) and a 48.5% by mass sodium dodecyl diphenyl ether disulfonate aqueous solution (25.0 parts) were mixed with stirring, and stirred with a TK homomixer (manufactured by PRIMIX Corporation) at 10000 rpm to prepare an aqueous medium.

The materials listed below were added to ethyl acetate (500 parts), and were dissolved with a propeller type stirrer at 100 rpm to prepare a dissolution solution:

copolymer of styrene-n-butyl acrylate (copolymerization ratio: styrene/n-butyl acrylate=75/25, Mp=17000) (100.0 parts)

saturated polyester resin (3.0 parts)

(terephthalic acid-propylene oxide-modified bisphenol A copolymer, acid value: 13 mgKOH/g, Mw: 14500)

C.I. Pigment Blue 15:3 (6.5 parts)

hydrocarbon wax having a peak temperature of at 77° C. as the largest endothermic peak (HNP-51, manufactured by NIPPON SEIRO CO., LTD.) (9.0 parts)

Next, the aqueous medium (150.0 parts) was placed in a container, and was stirred with a TK homomixer (manufactured by PRIMIX Corporation) at the number of rotations of 12000 rpm. The dissolution solution (100 parts) was added thereto, and was mixed therewith for 10 minutes to prepare an emulsion slurry.

Subsequently, the emulsion slurry (100 parts) was placed in a flask equipped with a degassing pipe, a stirrer and a thermometer. While the emulsion slurry was being stirred at a stirring circumferential speed of 20 m/min, the solvent was removed under reduced pressure at 30° C. for 12 hours. The product was aged at 45° C. for four hours to prepare a slurry containing no solvent. After the slurry was filtered under reduced pressure, ion exchange water (300.0 parts) was added to the filtered cake, and was mixed with a TK homomixer to be dispersed again (at the number of rotations of 12000 rpm for 10 minutes), and the mixture was filtered. The filtered cake was dried in a dryer at 45° C. for 48 hours, and the dried product was sieved with a mesh having an opening of 75 μm to prepare Toner base particle 55. Toner base particle 55 was partially extracted, and the glass transition temperature Tg was measured. Tg was 51.8° C.

A 0.1 mol/L-$Na_3PO_4$ aqueous solution (850.0 parts) was placed in a container equipped with a high-speed stirrer Clearmix (manufactured by M Technique Co., Ltd.). The number of rotations was adjusted to 15000 rpm, and the solution was heated to 60° C. A 1.0 mol/L-$CaCl_2$ aqueous solution (68.0 parts) was added thereto to prepare an aqueous medium containing a microfine, poorly water-soluble dispersant $Ca_3(PO_4)_2$.

Toner base particle 55 (250.0 parts) was added to the aqueous medium, and was dispersed at a temperature of 60° C. for 15 minutes while Clearmix was operated at 15000 rpm. Ion exchange water was added to adjust the concentration of the toner base particle in the dispersion liquid to 20%. A dispersion liquid of Toner base particle 55 was prepared.

The dispersion liquid of Toner base particle 55 (500.0 parts) (solid content: 100.0 parts) was placed in a reaction container equipped with a reflux cooling tube, a stirrer and a thermometer. A dispersion liquid of Resin fine particle E-2 (15.0 parts) (solid content: 3.0 parts) was slowly added with stirring, and was stirred at 200 rotations/min for 15 minutes. The temperature of the dispersion liquid of toner base particles to which the resin fine particles applied was kept at 80° C. (temperature during heating) with an oil bath heater, and the dissolution solution was continuously stirred for one hour. After the dispersion liquid was cooled to 20° C., 10% hydrochloric acid was added until the pH reached 1.0. The solution was stirred for two hours, and was filtered. The filtered cake was redispersed in ion exchange water, and 10% hydrochloric acid was added to control the pH to 1.0. The solution was stirred for two hours. The solution was then filtered, and was sufficiently washed with ion exchange water. The product was dried, and was classified to prepare Toner particle 55.

Toner particle 55 underwent external addition of hydrophobic silica fine powder in the same manner as in Example 1 to prepare Toner 55.

Comparative Example 1

Toner 56 was prepared in the same manner as in Example 1 except that the aqueous dispersion of Resin particle E-1 was replaced by the aqueous dispersion of Resin particle E-18.

Comparative Example 2

Toner 57 was prepared in the same manner as in Example 1 except that the aqueous dispersion of Resin particle E-1 was replaced by the aqueous dispersion of Resin particle E-19.

Comparative Example 3

Preparation of Toner Base Particles

A 0.1 mol/L-$Na_3PO_4$ aqueous solution (850.0 parts) was placed in a container equipped with a high-speed stirrer Clearmix (manufactured by M Technique Co., Ltd.). The number of rotations was adjusted to 15000 rpm, and the solution was heated to 60° C. A 1.0 mol/L-$CaCl_2$ aqueous solution (68.0 parts) was added thereto to prepare an aqueous medium containing a fine, poorly water-soluble dispersant $Ca_3(PO_4)_2$. The aqueous medium was stirred for 30 minutes. The pH was then controlled to 6.0.

The materials listed below were dissolved with a propeller type stirrer at 100 rpm to prepare a dissolution solution:

styrene (70.0 parts)

n-butyl acrylate (30.0 parts)

saturated polyester resin (3.0 parts)

(terephthalic acid-propylene oxide-modified bisphenol A copolymer, acid value: 13 mgKOH/g, Mw: 14500)

Resin A-1 (3.0 parts)

Next, the materials listed below were added to the dissolution solution:

C.I. Pigment Blue 15:3 (6.5 parts)

ester wax (12.0 parts)

(main component: $C_{21}H_{43}COOC_{22}H_{45}$, melting point: 72.5° C.)

After the mixed solution was heated to a temperature of 60° C., the mixed solution was stirred with a TK homomixer (manufactured by PRIMIX Corporation) at 9000 r/min to be dissolved and dispersed.

A polymerization initiator 2,2'-azobis(2,4-dimethylvaleronitrile) (10.0 parts) was dissolved in the dispersion solution to prepare a polymerizable monomer composition. The polymerizable monomer composition was added to the aqueous medium. The mixture was granulated at a temperature of 60° C. for 15 minutes while Clearmix was operated at 15000 rpm.

The product was placed in a propeller type stirrer. While being stirred at 100 rpm, the product was reacted at a temperature of 70° C. for five hours. The product was heated to a temperature of 80° C. to be reacted for another five hours.

Next, ion exchange water (200.0 parts) was added. The refluxing pipe was detached, and a distillator was attached. Distillation was performed for five hours at an inner temperature of the container of 100° C. The distillation fraction was 700.0 parts. The temperature was lowered to 30° C. to prepare a polymer slurry. The polymer slurry was controlled to a pH of 1.0. The polymer slurry was stirred as it was for two hours. After the product was repeatedly subjected to filtration and washing with water three times, the solid content was recovered. The solid content was dried in a reduced pressure dryer at 30° C. for one day to prepare Toner particle 58.

Hydrophobic silica fine powder (2.0 parts) was mixed with Toner particle 58 (100.0 parts) in a Henschel mixer (manufactured by NIPPON COKE & ENGINEERING CO., LTD.) at 3000 rpm for 15 minutes to prepare Toner 58. The hydrophobic silica fine powder used as a fluidity improver was treated with dimethylsilicone oil (20% by mass), and had the number average size of primary particles of 10 nm and a BET specific surface area of 170 $m^2/g$.

In Toner particles 1 to 53 and Toner particles 55 to 58, the content of the metal element was determined by measurement with fluorescent X-rays. The results are shown in Table 6, in which the result equal to or less than the lower limit to be detected is expressed as ND. In Toners 1 to 53 and Toners 55 to 58, the performance was evaluated according to the following method. The results are shown in Table 7.

<Evaluation of Amount of Toner to be Charged>

A two-component developer was prepared as follows.

For evaluation of the amount of charging, a sample was prepared as follows. A magnetic carrier F813-300 (manufactured by Powdertech Co., Ltd., 276 g) and a toner to be evaluated (24 g) were placed in a 500 mL plastic bottle with a lid, and the bottle was shaken with a shaker (YS-LD: manufactured by YAYOI CO., LTD.) for one minute at a rate of four reciprocal movements per second.

The toners and the two-component developers were evaluated as follows.

<Evaluation of Amount of Toner to be Charged Under High Temperature and High Humidity>

The amount of charging was measured with an apparatus illustrated in FIG. 1. The two-component developer (30 g) was extracted, and was left to stand under an environment at high temperature and high humidity (30° C./85% RH) for five days and nights; then, the developer was placed in a 50 mL insulative plastic container, and the container was shaken at 200 times/min for three minutes.

(Method for Measuring Amount of Charging)

The amount of frictional charging of a two-component developer is measured as follows. The two-component developer (0.500 g) is placed in a metallic container for measurement 2 with a 500-mesh (opening: 25 μm) screen 3 illustrated in FIG. 1, and the container is covered with a metallic lid 4. At this time, the weight of the container for measurement 2 is measured, and is defined as W1 (g). Next, in a sucker 1 (at least a portion in contact with the container for measurement 2 is insulative), and the toner in the container is sucked from a suction port 7. An air adjusting valve 6 is adjusted to control the pressure of a vacuum gauge 5 to be 250 mmAq. In this state, the toner is sufficiently sucked, preferably for two minutes to be removed.

The potential on a potential meter 9 at this time is defined as V (volt). The capacitance of a capacitor 8 is defined as C (μF). After the suction, the weight of the container for measurement is measured, and is defined as W2 (g). The amount of frictional charging of the toner is calculated from the following expression: Amount of frictional charging (mC/kg)=(C×V)/(W1−W2)

<Evaluation of Environment Dependency of Amount of Toner to be Charged>

The amount of the toner to be charged was measured by the same method as in the evaluation of the amount of the toner to be charged under high temperature and high humidity except that the two-component developer was left to stand under an environment at low temperature and low humidity (10° C./15% RH). The absolute value of the ratio of the amount of charging under low temperature and low humidity to the amount of charging under high temperature and high humidity (amount of charging under low temperature and low humidity/amount of charging under high temperature and high humidity) was calculated for evaluation.

<Evaluation of Rising Properties of Amount of Charging>

A two-component developer (30 g) was extracted, and was left to stand under an environment at high temperature and high humidity (30° C./85% RH) for five days and nights. The developer was then placed in a 50 mL insulative plastic container. The container was shaken at 200 times/min for seconds, and the amount of charging was measured with the apparatus illustrated in FIG. 1. The amount of frictional charging determined in the evaluation of the amount of the toner to be charged under high temperature and high humidity was defined as an amount of saturated charging, and rising (%) was calculated from the following expression:

rising(%)={amount of charging after toner is shaken 180 times (mC/kg)/amount of saturated charging(mC/kg)}×100

<Evaluation of Image Density and Fogging>

Figure 2:
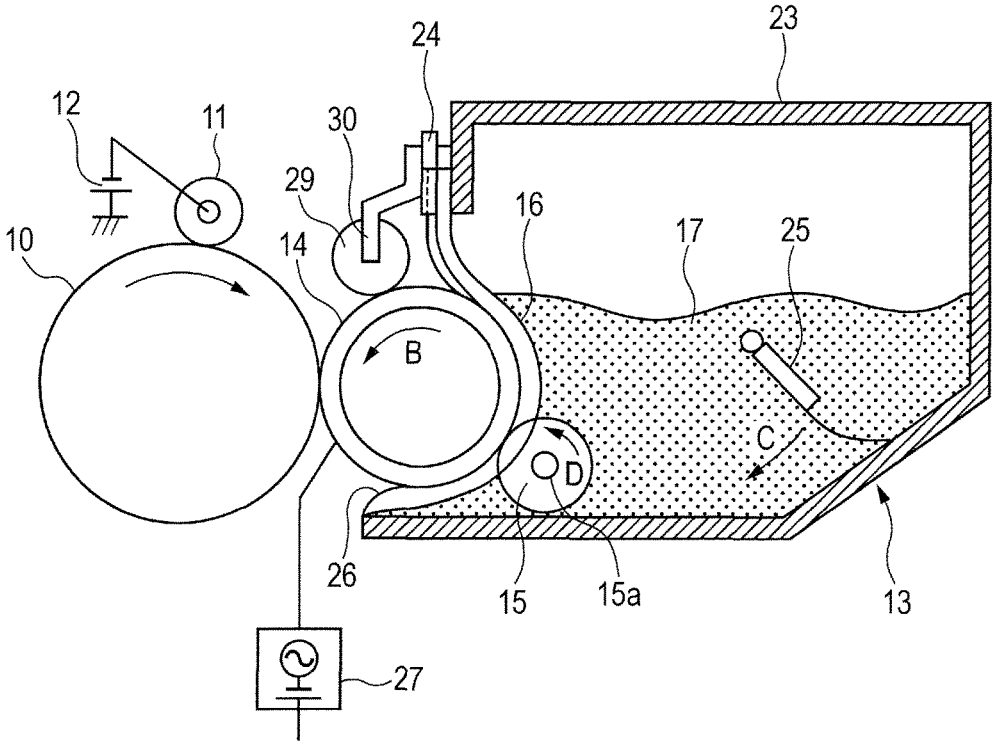
FIG. 2 is an enlarged view of a developing unit for an electrophotographic apparatus.

In a modified developing apparatus (Satera LBP5300; manufactured by Canon Inc.) of a one-component contact developing system illustrated in FIG. 2, a developer container was filled with a toner (70 g). The transfer paper used was Xerox 4200 (manufactured by Fuji Xerox Co., Ltd., 75 g/m$^2$ paper).

Figure 3:
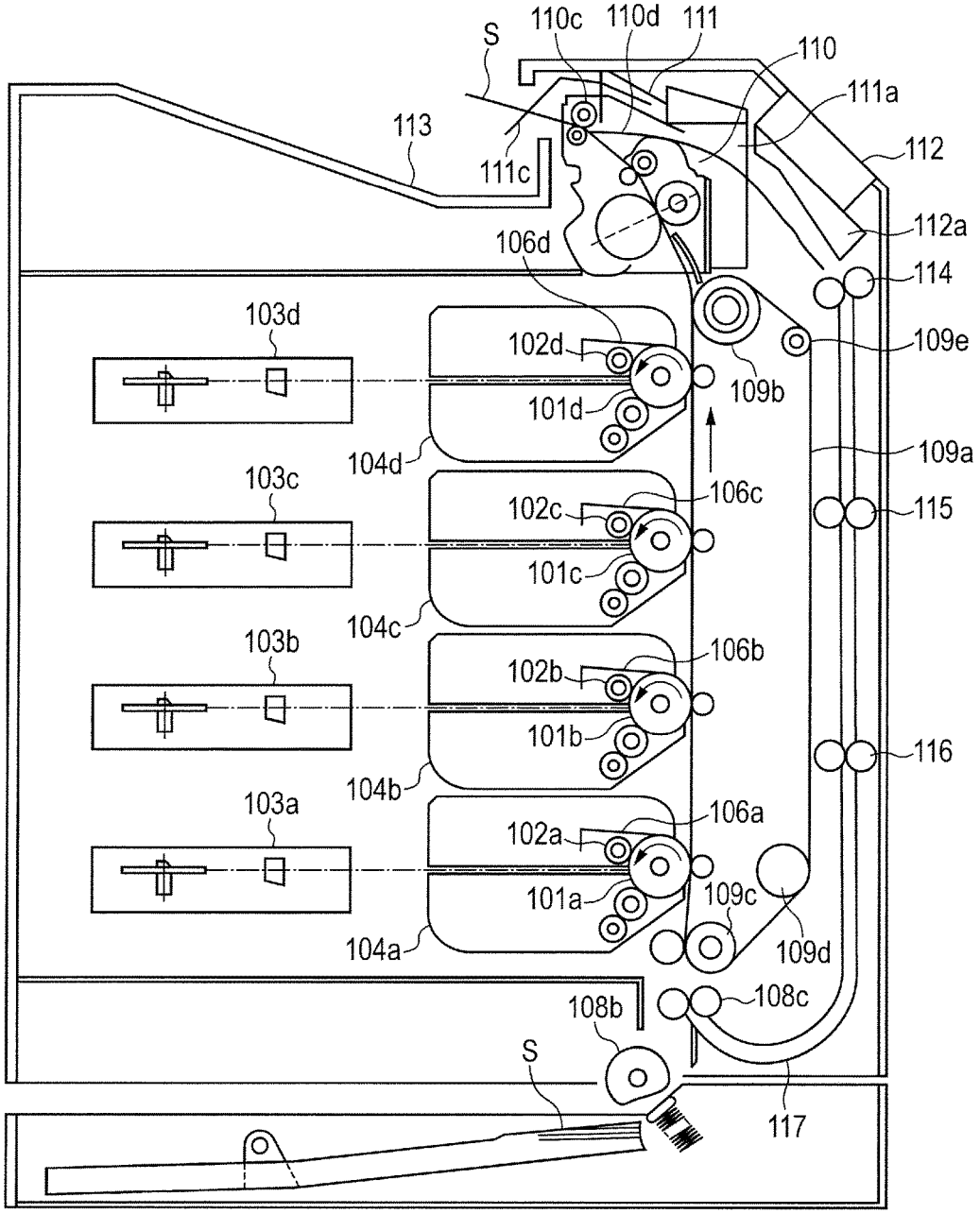
FIG. 3 is a cross sectional view of an electrophotographic apparatus using an image forming method according to the present invention.

The developing apparatus illustrated in FIG. 2 was mounted on a unit 104*a* illustrated in FIG. 3 under an environment at high temperature and high humidity (temperature: 30° C., humidity: 85% RH). A cyan monochromatic mode was selected, and the process speed was set at 200 mm/s. A solid image (image coverage rate: 4%) was continuously printed on the transfer paper such that the toner was disposed in an amount of 0.40 mg/cm$^2$. The image density and fogging of the image were measured in the first, the 4000th, and the 8000th printed papers. The results are shown in Table 7.

Toners 2, 30 to 53 and 55 to 58 were also evaluated in the following mode.

A developing apparatus illustrated in FIG. 2 was mounted on a unit 104*a* illustrated in FIG. 3 under an environment at high temperature and high humidity (temperature: 30° C., humidity: 85% RH). A cyan monochromatic mode was selected, and the process speed was set at 200 mm/s. A solid image (image coverage rate: 1%) was continuously printed on the transfer paper such that the toner was disposed in an amount of 0.40 mg/cm$^2$. The image density and fogging of the image were measured in the first and the 8000th printed papers. The results are shown in Table 8.

(Method for Measuring Image Density)

The image density was evaluated based on that of a solid portion. The image density was measured with a "Macbeth reflection densitometer RD918" (manufactured by Gretag-Macbeth GmbH) as a relative density to the image density of a printed image of an original image having a white solid portion (density: 0.00).

(Method for Measuring Fogging)

The reflectance (%) of the non-image portion of the printed image was measured with a "REFLECTOMETER MODEL TC-6DS" (manufactured by Tokyo Denshoku Co., Ltd.). A numeric value (%) obtained by subtraction of the reflectance from the reflectance (%) of the unused print paper (standard paper) determined in the same manner was used to evaluate fogging. A smaller numeric value indicates a larger reduction in image fogging.

TABLE 6

| | | Contents of metal elements (ppm) | | | |
|---|---|---|---|---|---|
| | | Mg | Ca | Ba | Al |
| Example 1 | Toner particle 1 | ND | ND | ND | ND |
| Example 2 | Toner particle 2 | ND | ND | ND | ND |
| Example 3 | Toner particle 3 | ND | ND | ND | ND |
| Example 4 | Toner particle 4 | ND | ND | ND | ND |
| Example 5 | Toner particle 5 | ND | ND | ND | ND |
| Example 6 | Toner particle 6 | ND | ND | ND | ND |
| Example 7 | Toner particle 7 | ND | ND | ND | ND |
| Example 8 | Toner particle 8 | ND | ND | ND | ND |
| Example 9 | Toner particle 9 | ND | ND | ND | ND |
| Example 10 | Toner particle 10 | ND | ND | ND | ND |
| Example 11 | Toner particle 11 | ND | ND | ND | ND |
| Example 12 | Toner particle 12 | ND | ND | ND | ND |
| Example 13 | Toner particle 13 | ND | ND | ND | ND |
| Example 14 | Toner particle 14 | ND | ND | ND | ND |
| Example 15 | Toner particle 15 | ND | ND | ND | ND |
| Example 16 | Toner particle 16 | ND | ND | ND | ND |
| Example 17 | Toner particle 17 | ND | ND | ND | ND |
| Example 18 | Toner particle 18 | ND | ND | ND | ND |
| Example 19 | Toner particle 19 | ND | ND | ND | ND |
| Example 20 | Toner particle 20 | ND | ND | ND | ND |
| Example 21 | Toner particle 21 | ND | ND | ND | ND |
| Example 22 | Toner particle 22 | ND | ND | ND | ND |
| Example 23 | Toner particle 23 | ND | ND | ND | ND |
| Example 24 | Toner particle 24 | ND | ND | ND | ND |
| Example 25 | Toner particle 25 | ND | ND | ND | ND |
| Example 26 | Toner particle 26 | ND | ND | ND | ND |
| Example 27 | Toner particle 27 | ND | ND | ND | ND |
| Example 28 | Toner particle 28 | ND | ND | ND | ND |
| Example 29 | Toner particle 29 | ND | ND | ND | ND |
| Example 30 | Toner particle 30 | ND | 45 | ND | ND |
| Example 31 | Toner particle 31 | 52 | ND | ND | ND |
| Example 32 | Toner particle 32 | ND | ND | 46 | ND |
| Example 33 | Toner particle 33 | ND | ND | ND | 30 |
| Example 34 | Toner particle 34 | ND | 66 | ND | ND |
| Example 35 | Toner particle 35 | 56 | ND | ND | ND |
| Example 36 | Toner particle 36 | ND | ND | 61 | ND |

TABLE 6-continued

| | | Contents of metal elements (ppm) | | | |
|---|---|---|---|---|---|
| | | Mg | Ca | Ba | Al |
| Example 37 | Toner particle 37 | ND | ND | ND | 35 |
| Example 38 | Toner particle 38 | ND | 44 | ND | ND |
| Example 39 | Toner particle 39 | 46 | ND | ND | ND |
| Example 40 | Toner particle 40 | ND | ND | 51 | ND |
| Example 41 | Toner particle 41 | ND | ND | ND | 57 |
| Example 42 | Toner particle 42 | ND | 9 | ND | ND |
| Example 43 | Toner particle 43 | ND | 12 | ND | ND |
| Example 44 | Toner particle 44 | ND | 18 | ND | ND |
| Example 45 | Toner particle 45 | ND | 23 | ND | ND |
| Example 46 | Toner particle 46 | ND | 110 | ND | ND |
| Example 47 | Toner particle 47 | ND | 162 | ND | ND |
| Example 48 | Toner particle 48 | ND | 190 | ND | ND |
| Example 49 | Toner particle 49 | ND | 230 | ND | ND |

TABLE 6-continued

| | | Contents of metal elements (ppm) | | | |
|---|---|---|---|---|---|
| | | Mg | Ca | Ba | Al |
| Example 50 | Toner particle 50 | ND | 473 | ND | ND |
| Example 51 | Toner particle 51 | ND | 968 | ND | ND |
| Example 52 | Toner particle 52 | ND | 1192 | ND | ND |
| Example 53 | Toner particle 53 | ND | ND | ND | ND |
| Example 54 | Toner particle 54 | Not measured due to coarse particles | | | |
| Example 55 | Toner particle 55 | ND | ND | ND | ND |
| Comparative Example 1 | Toner particle 56 | ND | ND | ND | ND |
| Comparative Example 2 | Toner particle 57 | ND | ND | ND | ND |
| Comparative Example 3 | Toner particle 58 | ND | ND | ND | ND |

TABLE 7

| | | Amount of toner to be charged under high temperature and high humidity (mC/kg) | Environmental dependency of amount of toner to be charged | Rising properties of amount of charging (%) | Image density | | | Fogging (%) | | |
|---|---|---|---|---|---|---|---|---|---|---|
| | | | | | 1st sheet | 4000th sheet | 8000th sheet | 1st sheet | 4000th sheet | 8000th sheet |
| Example 1 | Toner 1 | −65.2 | 1.08 | 80 | 1.45 | 1.44 | 1.42 | 0.0 | 0.1 | 0.2 |
| Example 2 | Toner 2 | −64.3 | 1.10 | 83 | 1.44 | 1.44 | 1.42 | 0.1 | 0.1 | 0.2 |
| Example 3 | Toner 3 | −63.4 | 1.12 | 82 | 1.45 | 1.45 | 1.43 | 0.2 | 0.2 | 0.3 |
| Example 4 | Toner 4 | −62.7 | 1.12 | 84 | 1.48 | 1.48 | 1.48 | 0.0 | 0.1 | 0.2 |
| Example 5 | Toner 5 | −61.0 | 1.09 | 84 | 1.47 | 1.46 | 1.42 | 0.0 | 0.0 | 0.2 |
| Example 6 | Toner 6 | −55.6 | 1.13 | 88 | 1.40 | 1.39 | 1.39 | 0.2 | 0.3 | 0.5 |
| Example 7 | Toner 7 | −66.1 | 1.10 | 83 | 1.45 | 1.45 | 1.44 | 0.1 | 0.2 | 0.4 |
| Example 8 | Toner 8 | −68.2 | 1.12 | 84 | 1.46 | 1.45 | 1.43 | 0.1 | 0.1 | 0.2 |
| Example 9 | Toner 9 | −61.8 | 1.13 | 82 | 1.42 | 1.42 | 1.40 | 0.1 | 0.2 | 0.4 |
| Example 10 | Toner 10 | −43.5 | 1.15 | 87 | 1.39 | 1.38 | 1.35 | 0.4 | 0.5 | 0.6 |
| Example 11 | Toner 11 | −50.6 | 1.18 | 80 | 1.40 | 1.38 | 1.30 | 0.2 | 0.4 | 0.6 |
| Example 12 | Toner 12 | −44.6 | 1.25 | 75 | 1.38 | 1.31 | 1.25 | 0.5 | 0.8 | 1.2 |
| Example 13 | Toner 13 | −60.1 | 1.11 | 80 | 1.42 | 1.42 | 1.41 | 0.2 | 0.2 | 0.3 |
| Example 14 | Toner 14 | −67.3 | 1.07 | 82 | 1.48 | 1.47 | 1.46 | 0.1 | 0.1 | 0.2 |
| Example 15 | Toner 15 | −70.3 | 1.19 | 76 | 1.37 | 1.35 | 1.30 | 0.3 | 0.5 | 0.7 |
| Example 16 | Toner 16 | −71.6 | 1.18 | 70 | 1.33 | 1.29 | 1.22 | 0.1 | 0.4 | 1.3 |
| Example 17 | Toner 17 | −45.3 | 1.13 | 83 | 1.38 | 1.36 | 1.35 | 0.3 | 0.4 | 0.6 |
| Example 18 | Toner 18 | −55.3 | 1.12 | 84 | 1.43 | 1.42 | 1.40 | 0.2 | 0.2 | 0.4 |
| Example 19 | Toner 19 | −58.3 | 1.10 | 80 | 1.44 | 1.44 | 1.42 | 0.2 | 0.3 | 0.4 |
| Example 20 | Toner 20 | −60.1 | 1.10 | 82 | 1.42 | 1.41 | 1.40 | 0.1 | 0.1 | 0.3 |
| Example 21 | Toner 21 | −64.8 | 1.12 | 83 | 1.43 | 1.42 | 1.41 | 0.2 | 0.2 | 0.3 |
| Example 22 | Toner 22 | −65.7 | 1.13 | 85 | 1.45 | 1.40 | 1.37 | 0.1 | 0.3 | 0.5 |
| Example 23 | Toner 23 | −63.5 | 1.13 | 80 | 1.45 | 1.44 | 1.44 | 0.1 | 0.1 | 0.2 |
| Example 24 | Toner 24 | −64.2 | 1.12 | 82 | 1.44 | 1.44 | 1.43 | 0.2 | 0.2 | 0.3 |
| Example 25 | Toner 25 | −63.8 | 1.13 | 81 | 1.45 | 1.44 | 1.42 | 0.1 | 0.1 | 0.2 |
| Example 26 | Toner 26 | −60.3 | 1.15 | 82 | 1.45 | 1.43 | 1.42 | 0.1 | 0.3 | 0.4 |
| Example 27 | Toner 27 | −30.2 | 1.45 | 71 | 1.39 | 1.32 | 1.23 | 0.4 | 0.6 | 1.2 |
| Example 28 | Toner 28 | −43.1 | 1.23 | 79 | 1.39 | 1.30 | 1.21 | 0.6 | 1.0 | 1.3 |
| Example 29 | Toner 29 | −52.5 | 1.19 | 81 | 1.40 | 1.38 | 1.35 | 0.3 | 0.5 | 0.8 |
| Example 30 | Toner 30 | −66.2 | 1.10 | 81 | 1.45 | 1.45 | 1.45 | 0.0 | 0.1 | 0.1 |
| Example 31 | Toner 31 | −64.6 | 1.08 | 80 | 1.44 | 1.44 | 1.43 | 0.1 | 0.1 | 0.2 |
| Example 32 | Toner 32 | −65.8 | 1.07 | 80 | 1.43 | 1.43 | 1.43 | 0.2 | 0.2 | 0.2 |
| Example 33 | Toner 33 | −64.2 | 1.10 | 81 | 1.43 | 1.43 | 1.42 | 0.1 | 0.2 | 0.2 |
| Example 34 | Toner 34 | −63.1 | 1.13 | 83 | 1.42 | 1.42 | 1.42 | 0.2 | 0.3 | 0.3 |
| Example 35 | Toner 35 | −63.9 | 1.12 | 81 | 1.45 | 1.44 | 1.44 | 0.1 | 0.2 | 0.2 |
| Example 36 | Toner 36 | −62.8 | 1.13 | 80 | 1.43 | 1.43 | 1.41 | 0.2 | 0.2 | 0.3 |
| Example 37 | Toner 37 | −63.8 | 1.12 | 81 | 1.44 | 1.44 | 1.43 | 0.1 | 0.2 | 0.2 |
| Example 38 | Toner 38 | −64.4 | 1.10 | 80 | 1.45 | 1.44 | 1.44 | 0.2 | 0.2 | 0.3 |
| Example 39 | Toner 39 | −64.7 | 1.11 | 81 | 1.42 | 1.42 | 1.42 | 0.1 | 0.1 | 0.2 |
| Example 40 | Toner 40 | −64.3 | 1.10 | 80 | 1.41 | 1.41 | 1.41 | 0.2 | 0.2 | 0.2 |
| Example 41 | Toner 41 | −64.5 | 1.11 | 81 | 1.43 | 1.43 | 1.42 | 0.1 | 0.1 | 0.2 |
| Example 42 | Toner 42 | −65.1 | 1.09 | 80 | 1.44 | 1.43 | 1.43 | 0.1 | 0.2 | 0.2 |
| Example 43 | Toner 43 | −65.4 | 1.08 | 80 | 1.42 | 1.42 | 1.42 | 0.1 | 0.2 | 0.3 |
| Example 44 | Toner 44 | −65.5 | 1.07 | 81 | 1.43 | 1.43 | 1.42 | 0.2 | 0.2 | 0.3 |
| Example 45 | Toner 45 | −65.7 | 1.08 | 80 | 1.43 | 1.42 | 1.42 | 0.2 | 0.2 | 0.2 |
| Example 46 | Toner 46 | −66.6 | 1.10 | 82 | 1.44 | 1.44 | 1.44 | 0.1 | 0.1 | 0.1 |
| Example 47 | Toner 47 | −64.8 | 1.09 | 81 | 1.43 | 1.43 | 1.43 | 0.1 | 0.1 | 0.1 |
| Example 48 | Toner 48 | −64.2 | 1.08 | 80 | 1.44 | 1.44 | 1.43 | 0.2 | 0.1 | 0.1 |
| Example 49 | Toner 49 | −66.9 | 1.16 | 80 | 1.42 | 1.42 | 1.42 | 0.1 | 0.1 | 0.2 |
| Example 50 | Toner 50 | −67.2 | 1.18 | 80 | 1.42 | 1.42 | 1.43 | 0.2 | 0.2 | 0.3 |

TABLE 7-continued

| | | Amount of toner to be charged under high temperature and high humidity (mC/kg) | Environmental dependency of amount of toner to be charged | Rising properties of amount of charging (%) | Image density | | | Fogging (%) | | |
|---|---|---|---|---|---|---|---|---|---|---|
| | | | | | 1st sheet | 4000th sheet | 8000th sheet | 1st sheet | 4000th sheet | 8000th sheet |
| Example 51 | Toner 51 | −67.6 | 1.21 | 80 | 1.43 | 1.43 | 1.43 | 0.1 | 0.2 | 0.2 |
| Example 52 | Toner 52 | −70.2 | 1.33 | 77 | 1.42 | 1.41 | 1.40 | 0.3 | 0.3 | 0.4 |
| Example 53 | Toner 53 | −65.2 | 1.08 | 80 | 1.45 | 1.44 | 1.41 | 0.0 | 0.1 | 0.3 |
| Example 54 | Toner 54 | Not evaluated due to coarse particles | | | | | | | | |
| Example 55 | Toner 55 | −44.3 | 1.32 | 78 | 1.40 | 1.30 | 1.24 | 0.4 | 0.7 | 1.4 |
| Comparative Example 1 | Toner 56 | −18.6 | 2.36 | 65 | 1.18 | 1.15 | 1.14 | 1.5 | 2.0 | 2.3 |
| Comparative Example 2 | Toner 57 | −50.3 | 1.24 | 70 | 1.30 | 1.12 | 1.09 | 0.8 | 1.8 | 2.1 |
| Comparative Example 3 | Toner 58 | −60.0 | 1.19 | 85 | 1.43 | 1.30 | 1.20 | 0.1 | 0.6 | 2.3 |

TABLE 8

| | | Image density | | Fogging (%) | |
|---|---|---|---|---|---|
| | | 1st sheet | 8000th sheet | 1st sheet | 8000th sheet |
| Example 2 | Toner 2 | 1.45 | 1.20 | 0.1 | 1.2 |
| Example 30 | Toner 30 | 1.45 | 1.44 | 0.1 | 0.2 |
| Example 31 | Toner 31 | 1.43 | 1.43 | 0.1 | 0.1 |
| Example 32 | Toner 32 | 1.43 | 1.42 | 0.2 | 0.3 |
| Example 33 | Toner 33 | 1.43 | 1.43 | 0.2 | 0.2 |
| Example 34 | Toner 34 | 1.42 | 1.42 | 0.2 | 0.2 |
| Example 35 | Toner 35 | 1.44 | 1.44 | 0.1 | 0.1 |
| Example 36 | Toner 36 | 1.43 | 1.43 | 0.2 | 0.2 |
| Example 37 | Toner 37 | 1.43 | 1.42 | 0.2 | 0.3 |
| Example 38 | Toner 38 | 1.44 | 1.43 | 0.2 | 0.3 |
| Example 39 | Toner 39 | 1.43 | 1.42 | 0.1 | 0.1 |
| Example 40 | Toner 40 | 1.42 | 1.42 | 0.2 | 0.2 |
| Example 41 | Toner 41 | 1.42 | 1.41 | 0.1 | 0.1 |
| Example 42 | Toner 42 | 1.44 | 1.25 | 0.1 | 1.0 |
| Example 43 | Toner 43 | 1.44 | 1.30 | 0.2 | 0.8 |
| Example 44 | Toner 44 | 1.43 | 1.36 | 0.2 | 0.6 |
| Example 45 | Toner 45 | 1.42 | 1.40 | 0.2 | 0.4 |
| Example 46 | Toner 46 | 1.44 | 1.43 | 0.1 | 0.1 |
| Example 47 | Toner 47 | 1.43 | 1.42 | 0.1 | 0.1 |
| Example 48 | Toner 48 | 1.43 | 1.41 | 0.2 | 0.3 |
| Example 49 | Toner 49 | 1.42 | 1.39 | 0.1 | 0.5 |
| Example 50 | Toner 50 | 1.42 | 1.38 | 0.2 | 0.7 |
| Example 51 | Toner 51 | 1.43 | 1.33 | 0.1 | 0.8 |
| Example 52 | Toner 52 | 1.40 | 1.23 | 0.4 | 1.2 |
| Example 53 | Toner 53 | 1.44 | 1.21 | 0.1 | 1.2 |
| Comparative Example 1 | Toner 56 | 1.18 | 1.1 | 1.3 | 2.4 |
| Comparative Example 2 | Toner 57 | 1.28 | 1.05 | 0.7 | 2.5 |
| Comparative Example 3 | Toner 58 | 1.44 | 1.15 | 0.1 | 2.5 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

REFERENCE SIGNS LIST

1 sucker, 2 container for measurement, 3 screen, 4 lid, 5 vacuum gauge, 6 air adjusting valve, 7 suction port, 8 capacitor, 9 potential meter, 10 latent image carrier (photosensitive drum), 11 contact charging member, 12 power supply, 13 developing unit, 14 toner carrier, 15 toner feed roller, 15*a* toner feed roller shaft, 16 regulating member, non-magnetic toner, 23 developer container, 24 regulating member support sheet metal, 25 toner stirring member, 26 toner spill preventing sheet, 27 power supply, charging roller, 30 suppressing member, 101*a* to 101*d* photosensitive drum, 102*a* to 102*d* primary charging unit, 103*a* to 103*d* scanner, 104*a* to 104*d* developing unit, 106*a* to 106*d* cleaning unit, 108*b* sheet feed roller, 108*c* registration roller, 109*a* electrostatically adsorbing conveying belt, 109*b* driving roller, 109*c* fixing roller, 109*d* tension roller, 109*e* fixing roller, 110 fixing unit, 110*c* ejecting roller, 110*d* discharging sheet, 111 fixing unit frame, 111*a* sheet guide, 112 door for fixing unit maintenance, 112*a* fixing unit fixing member, 113 output tray, 115, 116 ejecting roller, 117 paper guide, S recording medium This application claims the benefit of Japanese Patent Application No. 2014-067127, filed Mar. 27, 2014, and Japanese Patent Application No. 2014-199726, filed Sep. 30, 2014, which are hereby incorporated by reference herein in their entirety.

What is claimed is:

1. A toner comprising a toner particle comprising a toner base particle containing a binder resin, a colorant and a releasing agent; and a resin particle adhering to the surface of the toner base particle, wherein the resin particle has a negatively charging characteristic and contains a resin A having an acid dissociation constant pKa of 7.0 to 9.0, resin A comprising a monovalent group a represented by Formula (1):

(1)

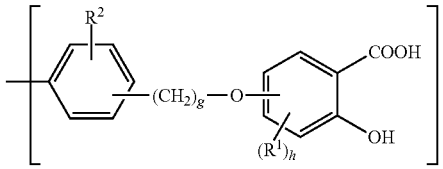

where $R^1$ represents a hydroxy group, a carboxy group, an alkyl group having 1 to 18 carbon atoms, or an alkoxy group having 1 to 18 carbon atoms; $R^2$ represents a hydrogen atom, a hydroxy group, an alkyl group having 1 to 18 carbon atoms, or an alkoxy group having 1 to 18 carbon atoms; g represents an integer of 1 to 3; h represents an integer of 0 to 3; and when h is 2 or 3, a number h of $R^1$ may be the same or different.

2. The toner according to claim 1, wherein a content of the group a per gram of the resin A is 50 to 1000 μmol.

3. The toner according to claim 1, wherein the toner particle contains at least one metal element selected from the group consisting of magnesium, calcium, barium and aluminum.

4. The toner according to claim 3, wherein the metal element is contained in the toner particle in a content of 10 to 1000 ppm relative to the total mass of the toner particle.

5. The toner according to claim 3, wherein the metal element is contained in the toner particle in a content of 20 to 200 ppm relative to the total mass of the toner particle.

6. The toner according to claim 1, wherein the toner base particle contains a resin having a carboxy group.

7. A method for producing toner particles, the toner particle comprising a toner base particle containing a binder resin, a colorant and a releasing agent; and a resin particle adhering to the surface of the toner base particle, the method comprising, in this order:

(i) forming particles of a polymerizable monomer composition containing a polymerizable monomer and a colorant in an aqueous medium, (ii) polymerizing the polymerizable monomer contained in the particles of the polymerizable monomer composition to prepare a dispersion liquid B containing the toner base particle, (iii) adding the resin particle to the dispersion liquid B to prepare a dispersion liquid C, and (iv) heating the dispersion liquid C to a temperature equal to or higher than the glass transition temperature (Tg) of the toner base particle to cause the resin particle to adhere to the surface of the toner base particle to prepare a toner particle, wherein the resin particle has a negatively charging characteristic and contains a resin A having an acid dissociation constant pKa of 7.0 to 9.0, resin A comprising a monovalent group a represented by Formula (1):

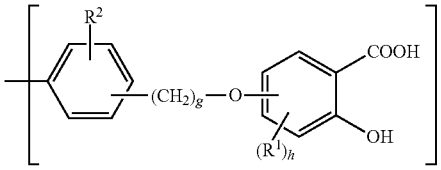

(1)

where $R^1$ represents a hydroxy group, a carboxy group, an alkyl group having 1 to 18 carbon atoms, or an alkoxy group having 1 to 18 carbon atoms; $R^2$ represents a hydrogen atom, a hydroxy group, an alkyl group having 1 to 18 carbon atoms, or an alkoxy group having 1 to 18 carbon atoms; g represents an integer of 1 to 3; h represents an integer of 0 to 3; and when h is 2 or 3, a number h of $R^1$ may be the same or different.

8. The method for producing toner particles according to claim 7, wherein the aqueous medium contains an inorganic dispersion stabilizer.

9. The method for producing toner particles according to claim 7, wherein the inorganic dispersion stabilizer is at least one member selected from the group consisting of a calcium phosphate compound, an aluminum phosphate compound, a magnesium phosphate compound, a calcium hydroxide compound, an aluminum hydroxide compound, a magnesium hydroxide compound, a calcium carbonate compound, an aluminum carbonate compound and a magnesium carbonate compound.

10. The method for producing toner particles according to claim 7, further comprising removing the inorganic dispersion stabilizer at a temperature equal to or lower than the glass transition temperature (Tg) of the toner base particle after the preparation of the toner particle.

11. The toner according to claim 1, wherein resin A is a vinyl polymer.

12. The toner according to claim 11, wherein a content of the group a per gram of the resin A is 50 to 1000 μmol.

13. The toner according to claim 11, wherein the toner particle contains at least one metal element selected from the group consisting of magnesium, calcium, barium and aluminum.

14. The toner according to claim 13, wherein the metal element is contained in the toner particle in a content of 10 to 1000 ppm relative to the total mass of the toner particle.

15. The toner according to claim 13, wherein the metal element is contained in the toner particle in a content of 20 to 200 ppm relative to the total mass of the toner particle.

16. The toner according to claim 11, wherein the toner base particle contains a resin having a carboxy group.

17. The method for producing toner particles according to claim 7, wherein resin A is a vinyl polymer.

* * * * *